US008188354B2

(12) United States Patent
Mercer

(10) Patent No.: US 8,188,354 B2
(45) Date of Patent: May 29, 2012

(54) SUPPORT DEVICE FOR A GUITAR OR OTHER MUSICAL INSTRUMENT

(76) Inventor: James Mercer, Shearstown (CA)

( * ) Notice: Subject to any disclaimer, the term of this patent is extended or adjusted under 35 U.S.C. 154(b) by 0 days.

(21) Appl. No.: 12/229,017

(22) Filed: Aug. 19, 2008

(65) Prior Publication Data

US 2009/0056522 A1 Mar. 5, 2009

(30) Foreign Application Priority Data

Aug. 30, 2007 (CA) ..... 2599763

(51) Int. Cl.
*G10D 3/00* (2006.01)

(52) U.S. Cl. ..... 84/327

(58) Field of Classification Search ..... 84/327, 84/421; 248/121

See application file for complete search history.

(56) References Cited

U.S. PATENT DOCUMENTS

| | | | | |
|---|---|---|---|---|
| 5,202,527 | A * | 4/1993 | Gracie | 84/327 |
| 6,005,176 | A * | 12/1999 | Yu | 84/327 |
| 6,028,257 | A * | 2/2000 | May | 84/421 |
| 6,040,513 | A * | 3/2000 | Belli | 84/411 R |
| 6,881,884 | B2 * | 4/2005 | Hsieh | 84/327 |
| 6,891,100 | B2 * | 5/2005 | Crouch | 84/421 |
| 7,541,529 | B1 * | 6/2009 | Blair | 84/327 |
| 2006/0113434 | A1 * | 6/2006 | Richter | 248/121 |

* cited by examiner

*Primary Examiner* — Jianchun Qin

(74) *Attorney, Agent, or Firm* — Frank J. Bonini, Jr.; John F. A. Earley, III; Harding, Earley, Follmer & Frailey, P.C.

(57) ABSTRACT

A device for supporting a musical instrument such as a guitar, on a stand, having, a first engagement mechanism adapted to engage with and support the musical instrument, a first strap adapted to releaseably engage with the musical instrument and in engagement with the first engagement mechanism, and a mechanism for securely and releasably engaging the first engagement mechanism to the stand.

17 Claims, 25 Drawing Sheets

SUPPORT DEVICE FOR A GUITAR OR OTHER MUSICAL INSTRUMENT

FIELD OF THE INVENTION

The present invention relates to support devices for musical instruments, and more particularly relates to support devices which may be utilized by a musician to support the musical instrument while it is being played, or alternatively, may be utilized by anyone who wants to support or display the musical instrument.

BACKGROUND OF THE INVENTION

Musical instruments may be awkward or heavy to support, particularly during lengthy practices or performances, which may result in the musician becoming fatigued, strained or tensioned and in some circumstances, physically stressed to the point of risking physical injury, potentially resulting in back, shoulder or neck injuries and/or repetitive strain injuries (RSI) such as tendinitis and other physical impairments, such as musculo-skeletal disorders (MSD) which may limit or end musical careers.

Previously, some musicians have utilized straps mounted to their musical instrument to support the musical instrument. However, these straps are generally positioned around the neck and on the shoulder of the musician, and while this may provide some relief to the musician's hands and arms, it nevertheless puts strain on the musician's neck and back. Furthermore, such straps are awkward to use properly and may result in poor posture during practices or performances, causing misalignment of the body's natural symmetry and attendant medical problems It is desirable to have a musical instrument support device which does not require the musician to bear any or all of the load of the musical instrument, while at the same time, permitting the musical instrument to be moved and manipulated and played effectively and in a natural manner by the musician during practices and/or performances.

It is also desirable to have a musical instrument support device which allows the musical instrument to be supported for the purposes of display, and/or maintenance work, such as, in the case of a guitar, the changing of the strings, or tuning of the guitar.

SUMMARY OF THE INVENTION

Accordingly, one object of the present invention is to provide a musical instrument support device which can support the musical device and which does not require the musician to bear any or all of the load of the musical instrument, while at the same time, permitting the musical instrument to be moved and manipulated and played effectively and in a natural manner by the musician during practices and/or performances.

Another object of the present invention is to provide a musical instrument support device which allows the musical instrument to be supported for the purposes of display, and/or maintenance work, such as, in the case of a guitar, the changing of the strings, or tuning of the guitar.

According to one aspect of the present invention, there is provided a device for supporting a musical instrument on a stand, comprising, a support structure for transmitting at least a substantial portion of a weight of the musical instrument to the stand while enabling relative movement between the musical instrument and the stand, the support structure comprising an engaging structure for securely engaging with the stand, a support seat mounted to the support structure for engaging with and supporting the musical instrument, and a securing mechanism mounted to at least one of the support structure and the support seat for securing engagement of the musical instrument with the support seat during the relative movement.

The advantage of the present invention is that it provides a musical instrument support device which can support the musical instrument and which does not require the musician to bear any or all of the load of the musical instrument, while at the same time, permitting the musical instrument to be moved and manipulated and played effectively and in a natural manner by the musician during practices and/or performances.

A further advantage of the present invention is that it provides a musical instrument support device which allows the musical instrument to be supported for the purposes of display, and/or maintenance work, such as, in the case of a guitar, the changing of the strings, or tuning of the guitar.

BRIEF DESCRIPTION OF THE DRAWINGS

A preferred embodiment of the present invention is described below with reference to the accompanying drawings, in which.

DESCRIPTION OF THE PREFERRED EMBODIMENT

Figure 1:
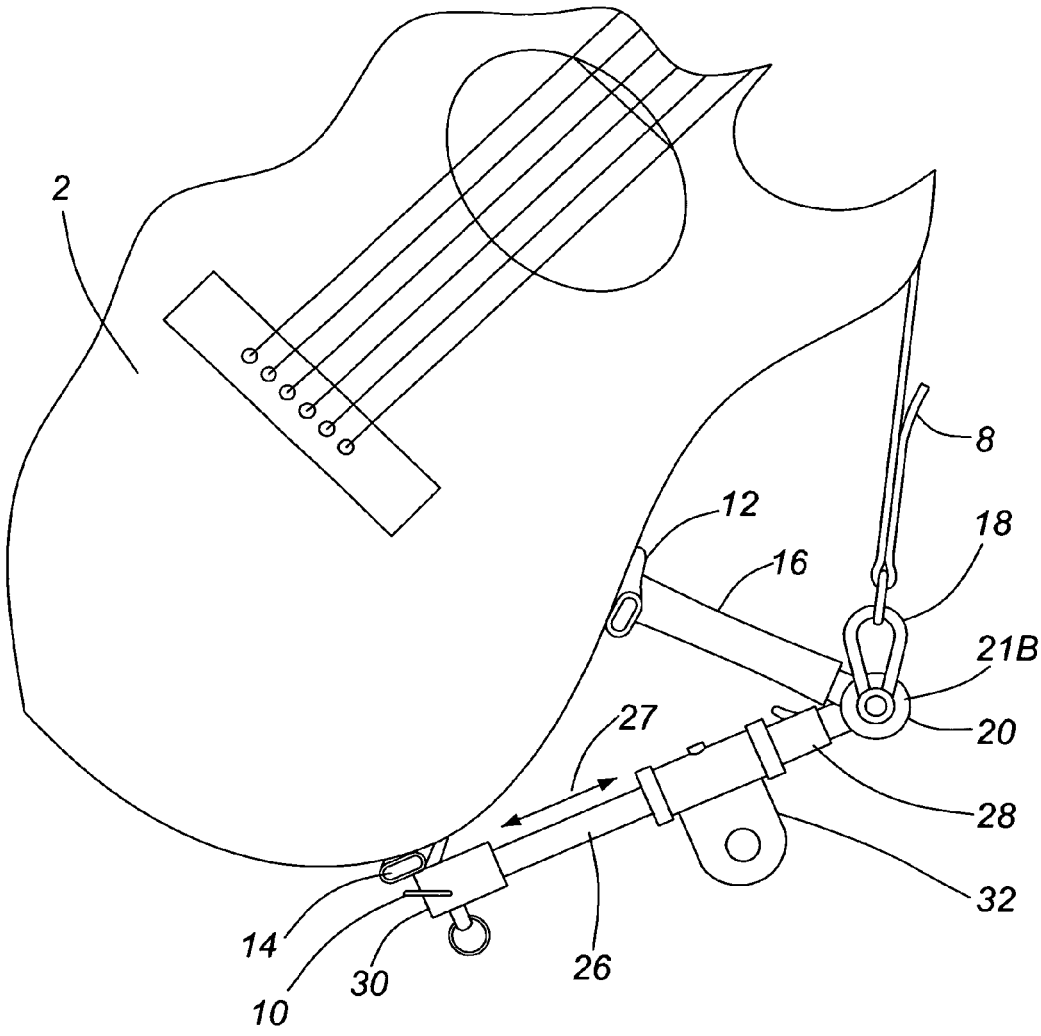
FIG. 1 is a perspective view of one embodiment of the present invention supporting an acoustic guitar.
Figure 8:
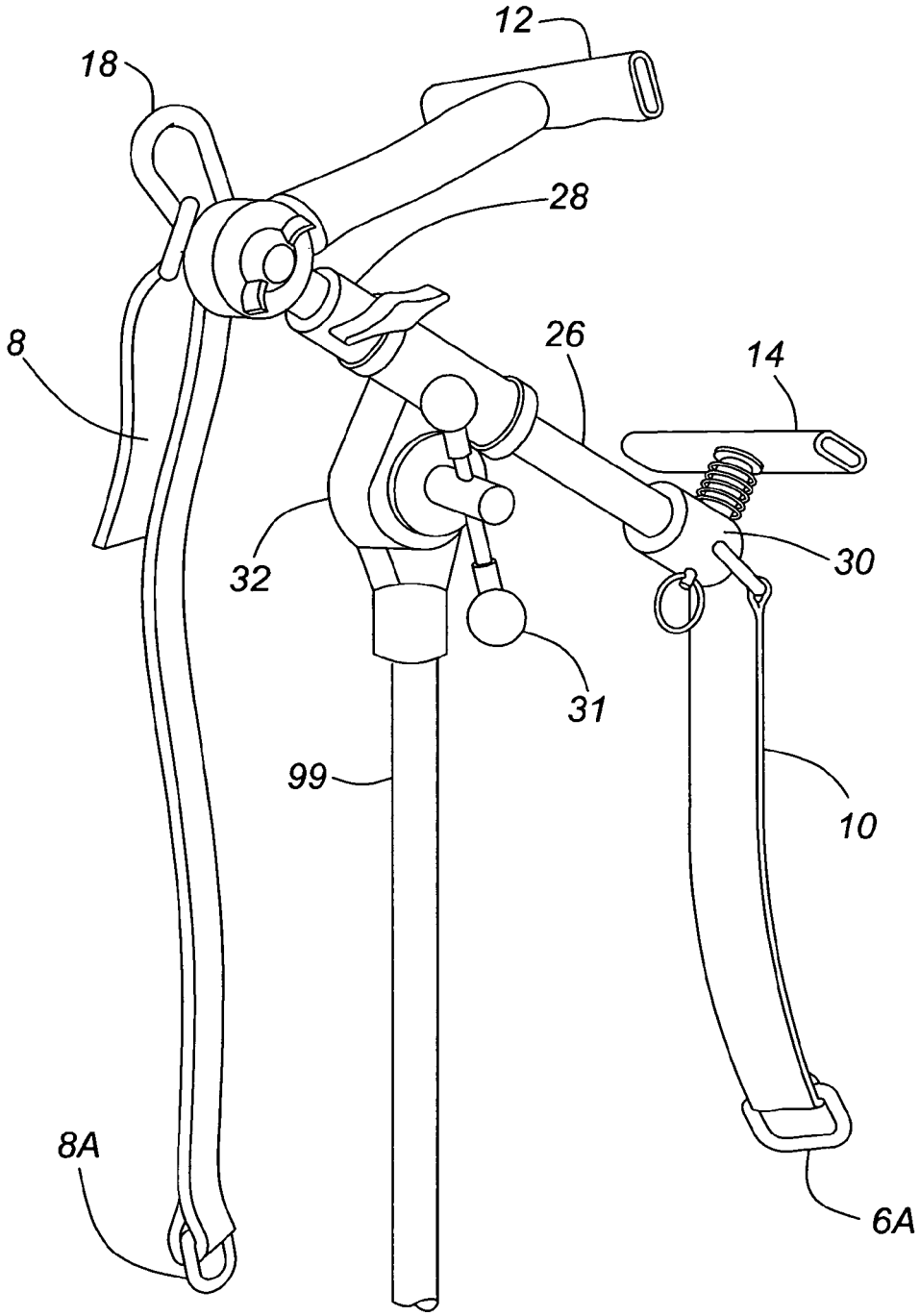
FIG. 8 is a perspective view of one embodiment of the present invention.
Figure 9:
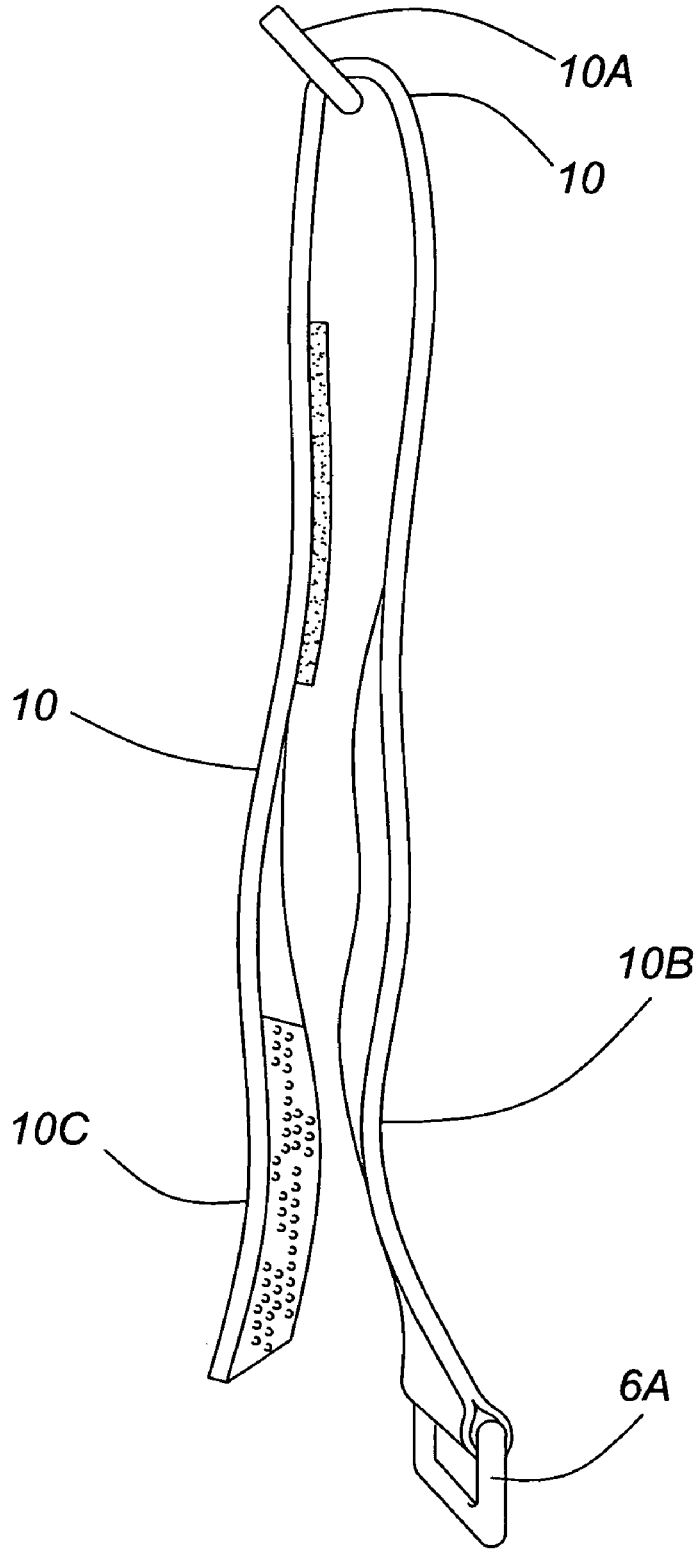
FIG. 9 is a perspective view of a rear strap of one embodiment of the present invention.

With reference to FIGS. 1 and 8, a support device is provided, which, in the preferred embodiment, may support a guitar 2 or other musical instrument (in the context of the present description of the invention, reference will be made specifically to a guitar, it being understood that the support device of the present invention may be utilized in the context of other stringed musical instruments specifically, and more generally to a wide variety of musical instruments, with appropriate modifications, all of which it will be understood are being referred to herein when reference is being made herein to a "guitar").

In the preferred embodiment of the present invention, as illustrated in FIGS. 1 and 8, the support device of the present invention presents a generally cylindrical and preferably steel slide tube 26 having a front end 28 and rear end 30, and supported therefrom, as more fully described herein, first and second generally horizontally oriented front and rear support seats 12 and 14 respectively upon which the guitar may be positioned, the front and rear support seats 12 and 14 as more fully illustrated in FIGS. 2A, 2B, 2C, 2D, 2E, 2F, 3, 4 and 6 respectively, preferably being made of cushioned inert padding such as plastic covered foam 34, or rubber, it being understood that alternative materials may be utilized as would be known to a person skilled in the art, the front and rear support seats being securely attached to front and rear posts 16 and 50 respectively in a manner known to a person skilled in the art. It is understood that in the context of the present invention, more than two support seats may be utilized.

Figure 2A:
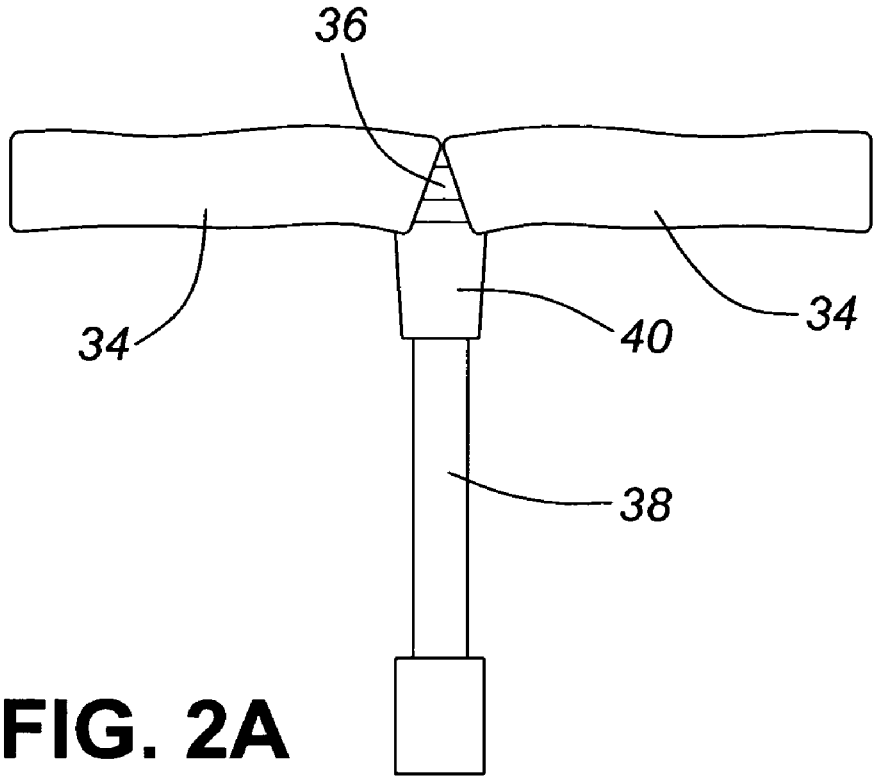
FIG. 2A is a perspective view of the front seat of one embodiment of the present invention.
Figure 2B:
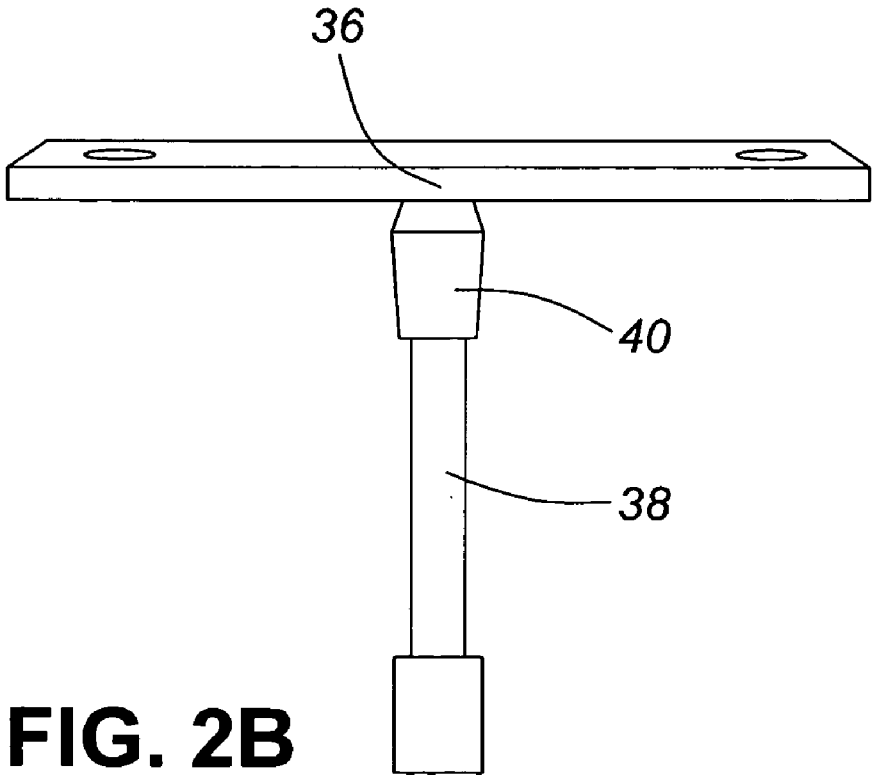
FIG. 2B is a perspective view of the front seat of one embodiment of the present invention with the rubber cushions removed therefrom.
Figure 2C:
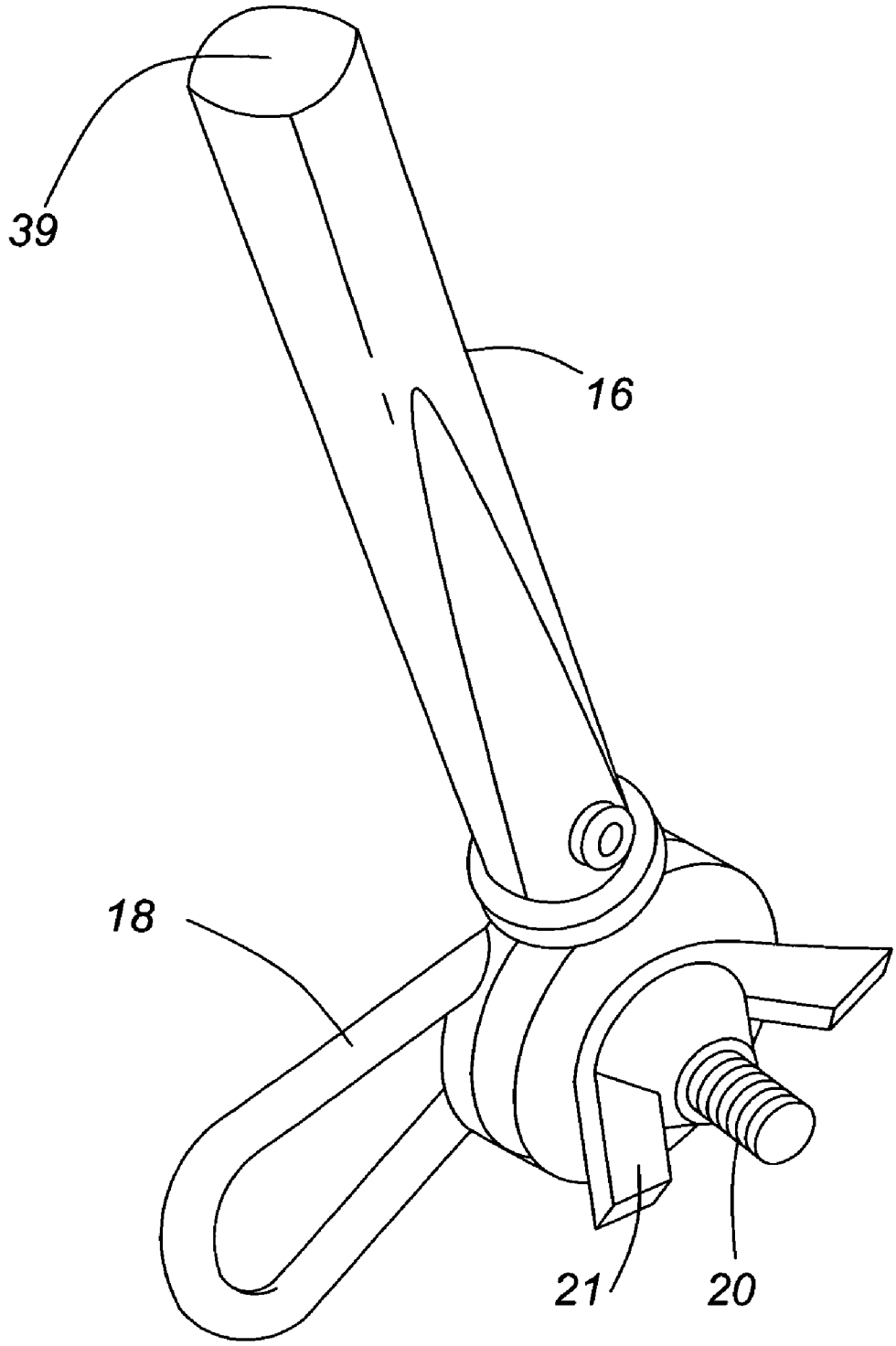
FIG. 2C is a perspective view of the hollow front post of one embodiment of the present invention.
Figures 2D, 2E:
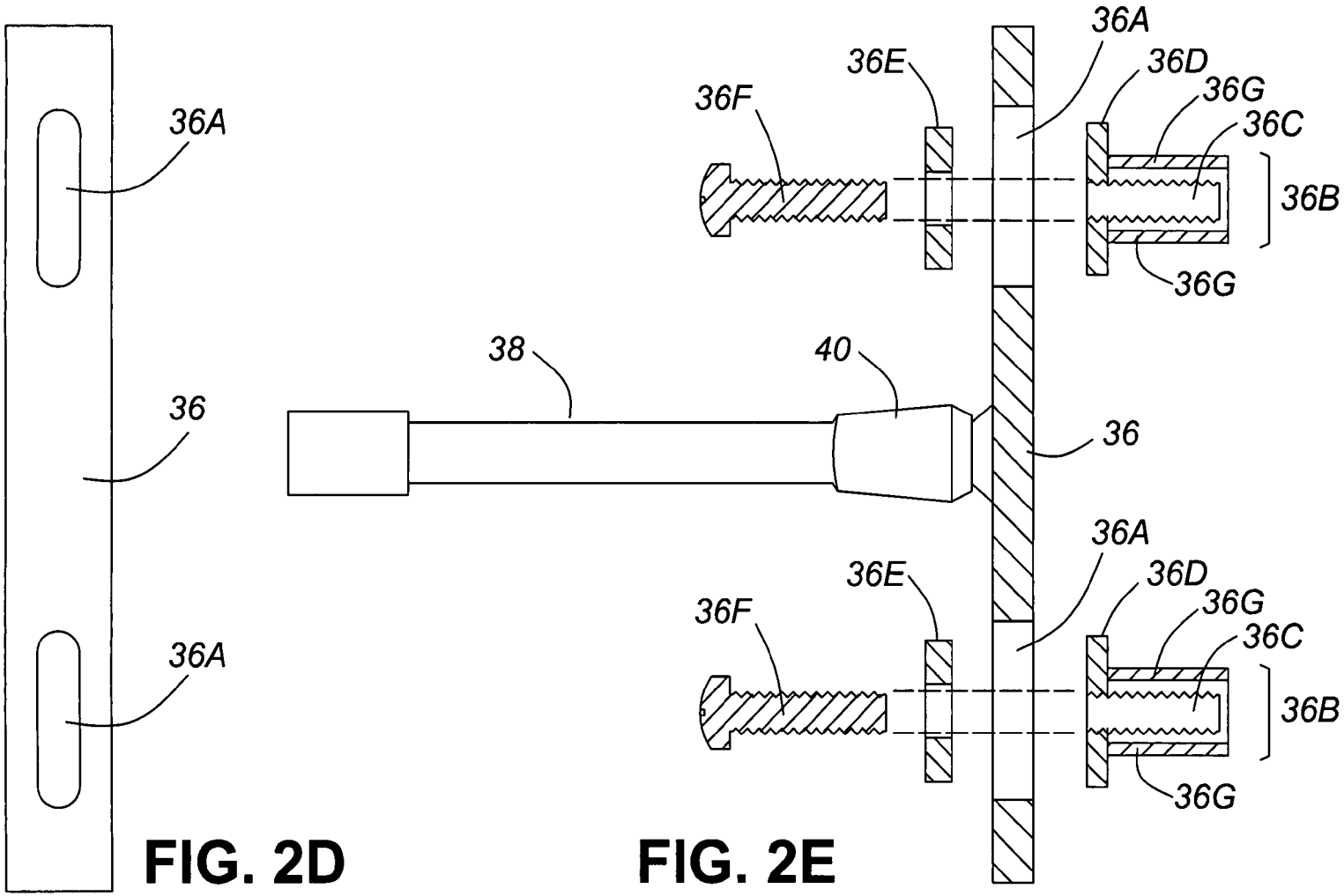
FIG. 2D is a top view of the front seat of one embodiment of the present invention, with the rubber cushions removed there from, and having slots therein for the insertion of support posts.
FIG. 2E is a side view, partially in cross-section, of the front seat of one embodiment of the present invention, with the rubber cushions removed there from, and having in exploded view, the support posts positioned relative to the front seat.
Figure 2F:
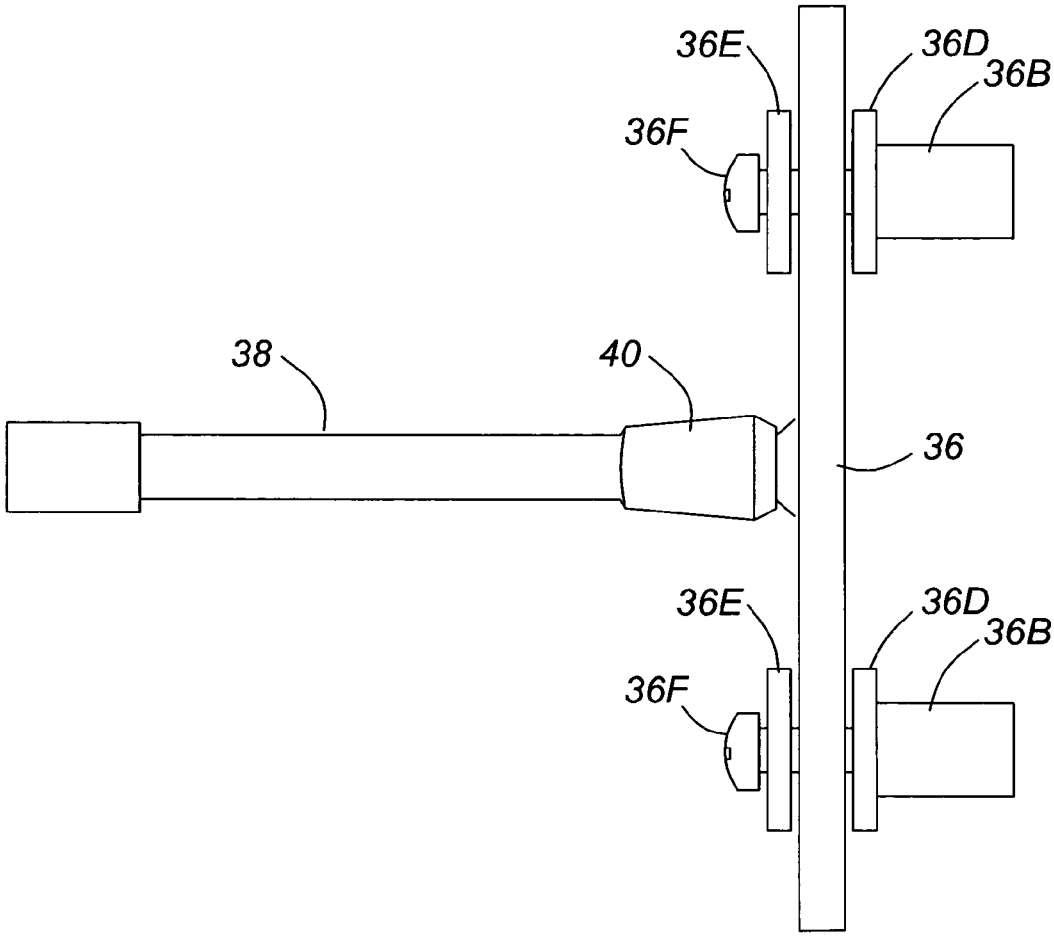
FIG. 2F is a side view of the front seat of one embodiment of the present invention, with the rubber cushions removed there from, and having the support posts positioned relative to the front seat.
Figure 3:
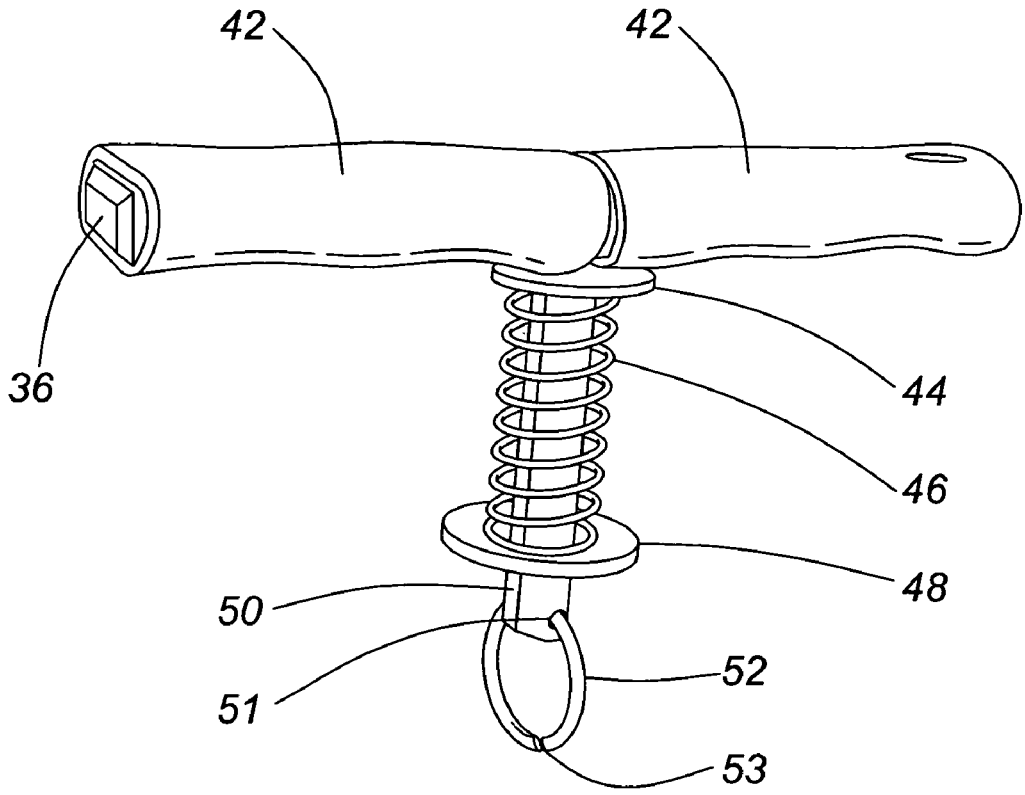
FIG. 3 is a perspective view of the rear seat and post of one embodiment of the present invention.

In a preferred embodiment, the plastic covered foam 34 and 42 of the front and rear support seats 12 and 14 respectively is positioned upon a support rod 36, the support rod 36 of the front seat being illustrated in FIGS. 2B, 2D, 2E and 2F, (the rear seat being similarly supported by a corresponding support rod illustrated in FIG. 3), which front seat support rod 36 is preferably welded or otherwise securely attached to, in the case of the front post of the preferred embodiment of the present invention, an insertable rod 38 upon which is positioned a tapered rubber bushing 40 as more fully described herein. The insertable rod 38 may be inserted into the hole 39 at one end of the hollow front post 16, as illustrated in FIG. 2C, and rotated to be appropriately engageable with the support surface of the supported guitar upon the installation of a guitar on the support device of the present invention. When the insertable rod 38 is fully inserted into the hollow front post 16, the tapered rubber bushing 40 will securely and temporarily engage with the inner upper surface of the hole 39, and may thereafter be disengaged by the user to reposition or reorient or rotate the insertable rod 38 as needed.

Figure 6:
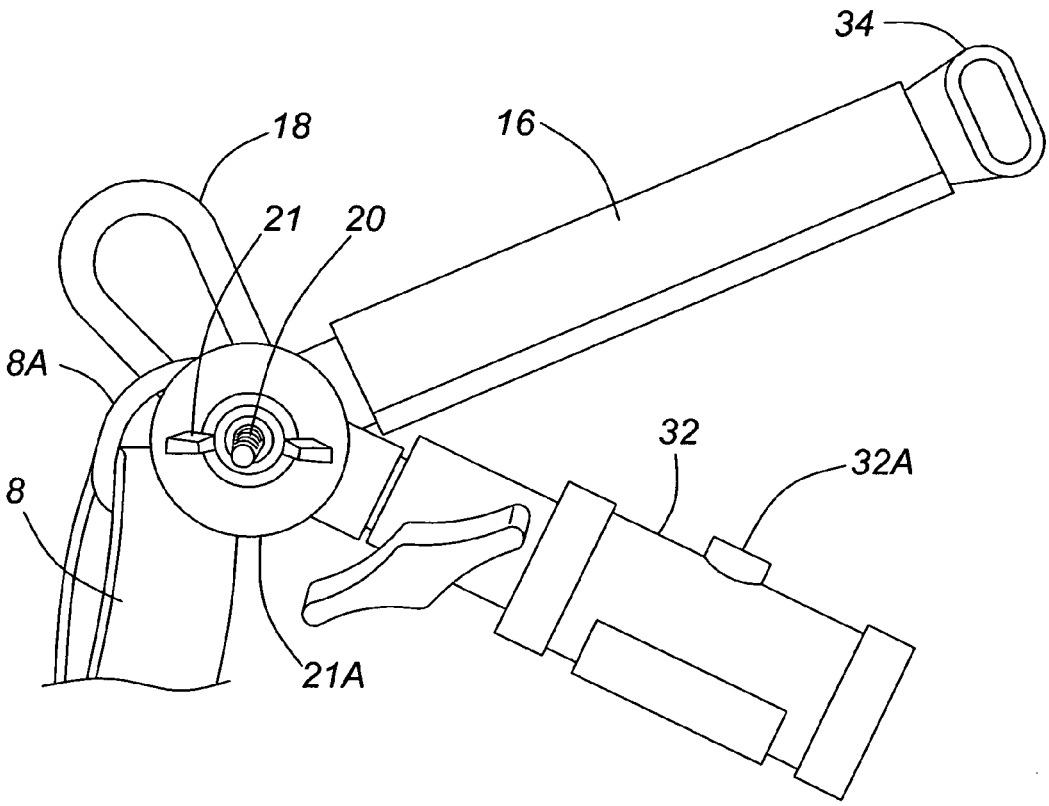
FIG. 6 is a perspective view of the front post and front end of the slide tube of one embodiment of the present invention.

In the preferred embodiment of the present invention the front post 16 may, for example, be securely engaged with the front end of the slide tube 28 as illustrated in FIGS. 2C and 6 by means of a bolt 20 and wingnut 21 which passes through corresponding holes in a first plate 21A welded or otherwise securely attached to the front end of the slide tube, as illustrated in FIG. 6, and the second plate 21B as illustrated in FIG. 1 welded or otherwise securely attached to the front post 16. When the bolt and wingnut are loosened, the front post may be rotated relative to the slide tube for properly engaging the front seat with the support surface of the guitar. Once properly oriented, the front post may be secured in that orientation by tightening the bolt and wingnut in a manner known to a person skilled in the art. The bolt and wingnut may, in one embodiment, be also used to secure the looped eye 18 or other device for the attachment of the front strap 8, by way of, for example, a strap ring 8B (as illustrated in FIG. 10B) or other similar device known to a person skilled in the art.

In one embodiment of the present invention, as illustrated in FIGS. 2D, 2E and 2F, two adjustable support posts 36B may be attached to the support rod 36 by way of, for example, bolts 36F inserted through washers 36E and slots 36A, and into the internally threaded hole 36C in the support posts 36B, which support posts 36B, in one embodiment, are positioned within a tubular rubber cushion 36G, which support posts 36B are adapted to be positioned proximate to, or gently and securely engage with a guitar which has been or is to be positioned on the support rod. In the preferred embodiment of the present invention, the support posts 36B preferably have a shoulder 36D adapted to rest upon the surface of the support rod 36 in the area proximate the slot 36A when the support post 36B has been securely fastened to the support rod 36. The slots 36A permit the support posts 36B to be positioned (prior to the tightening of the bolts 36F) on the support rod 36 at a distance from one another sufficient to permit the guitar to be seated securely on the seat, and to eliminate or substantially eliminate lateral movement of the guitar relative to the seat, thereby permitting the guitar to be securely positioned on the seat, the tubular rubber cushion 36G reducing or limiting the likelihood that the guitar will be damaged on coming into contact with the support post 36B.

Figure 7A:
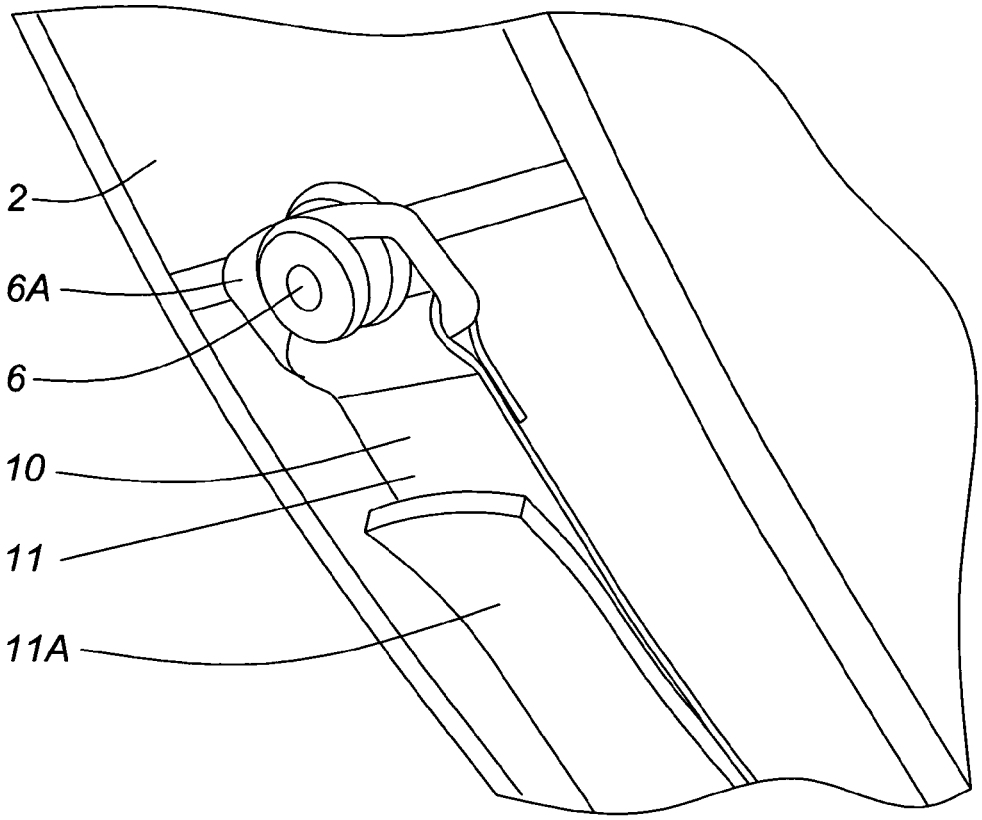
FIG. 7A is a perspective view of the rear strap of one embodiment of the present invention attached to the rear of an acoustic guitar.
Figure 7B:
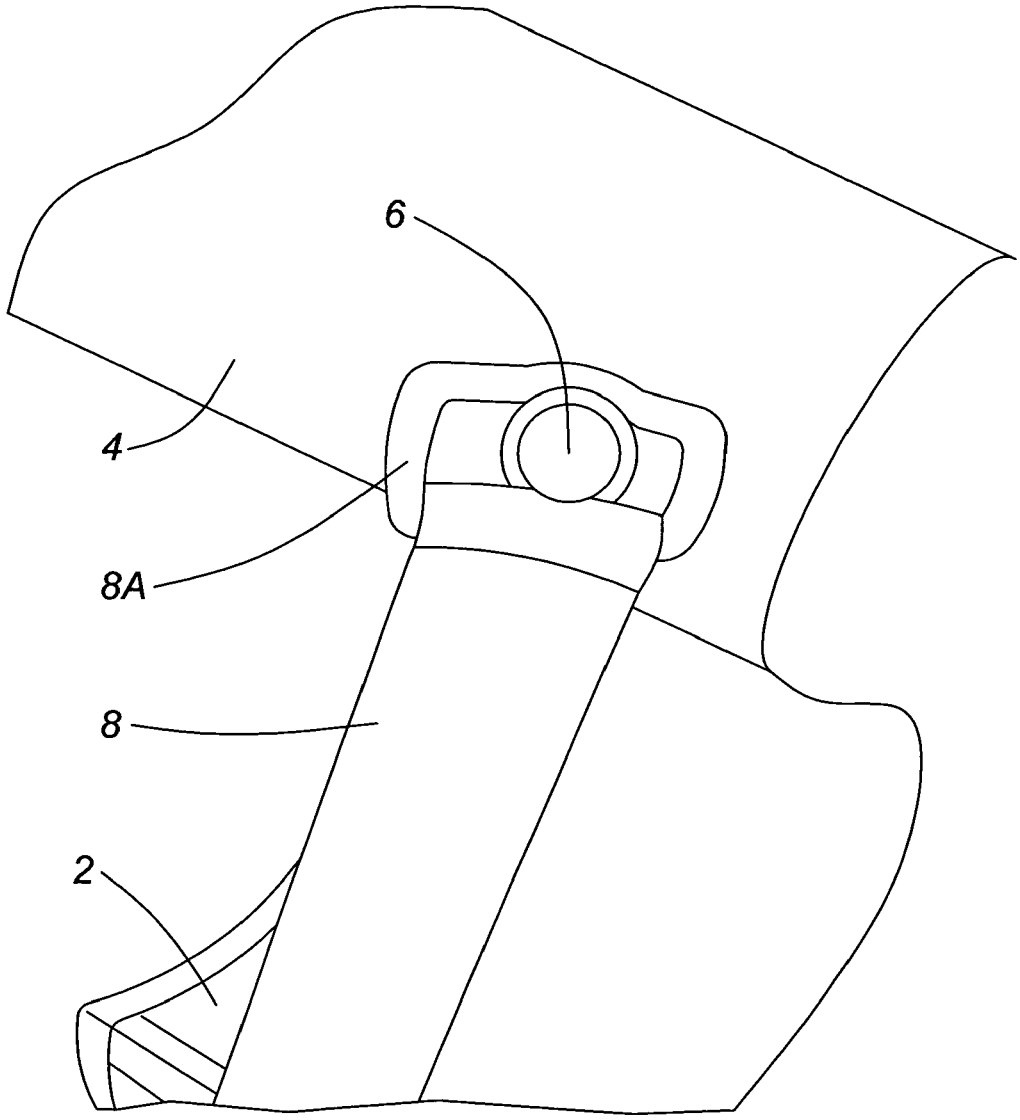
FIG. 7B is a perspective view of the front strap of one embodiment of the present invention attached to the front of an acoustic guitar.
Figure 10A:
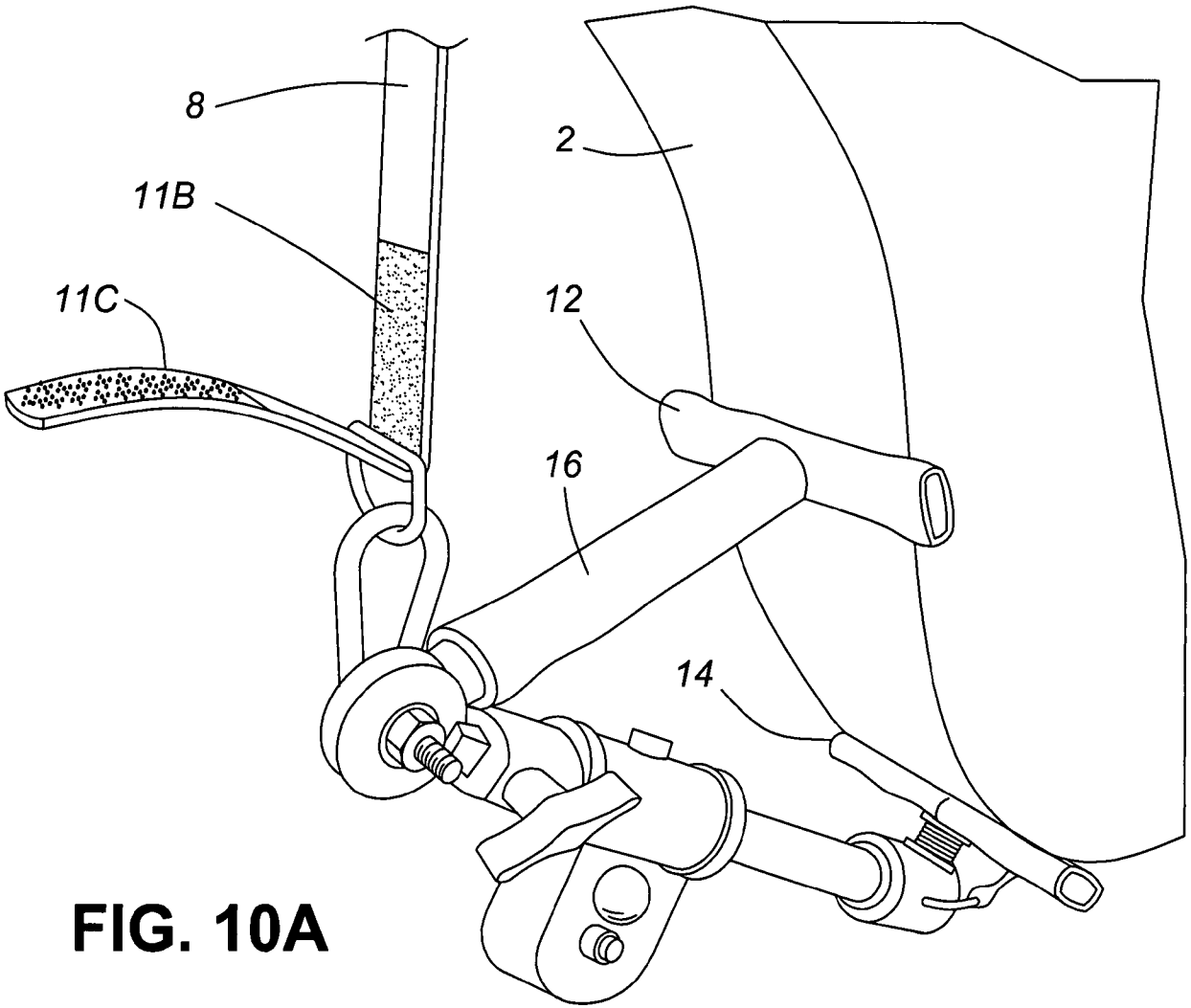
FIG. 10A is a perspective view of the front strap of one embodiment of the present invention with the Velcro® fastener in the disengaged position.
Figure 10B:
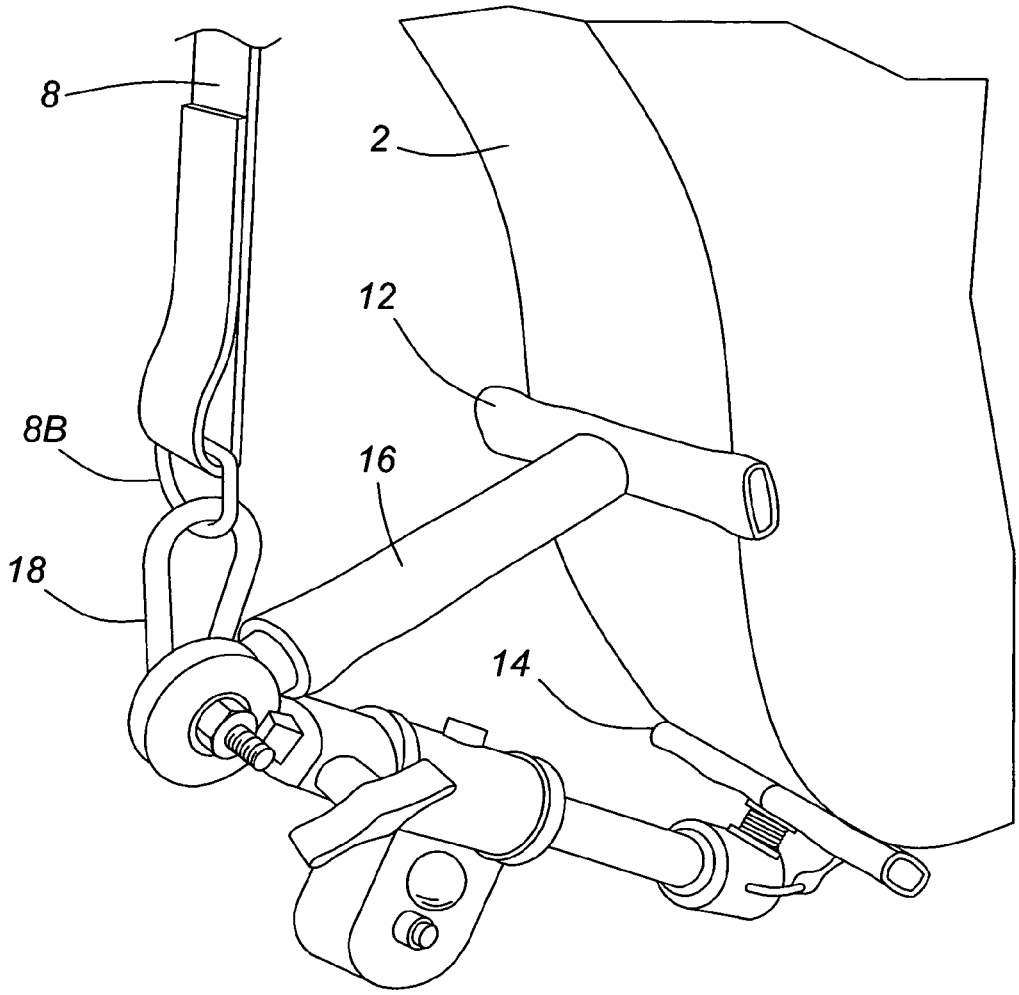
FIG. 10B is a perspective view of the front strap of one embodiment of the present invention with the Velcro® fastener in the engaged position.

As illustrated in FIGS. 1, 6, 7B, 8, 10A and 10B in the preferred embodiment of the present invention, a front strap 8 is provided, preferably having on one end thereof a strap post fastener 8A securely attached thereto for attachment to a strap post 6 (as illustrated in FIG. 7B) which has been attached to the guitar in a conventional manner, and for example, having attached to the other end thereof (as illustrated in FIG. 6), a front strap ring 8A which may be engaged, for example, through a loop eye 18 or other similar device to the front end of the slide tube. It is understood that a wide variety of arrangements may be provided for securely fastening the front strap to the guitar, and to the front end of the slide tube. In the preferred embodiment, the front strap uses a Velcro® hook and loop fastener system illustrated in the disengaged and engaged arrangements in FIGS. 10A and 10B respectively, FIG. 10A illustrating the hook surface 11B of the Velcro® and the loop surface 11C of the Velcro® when the Velcro® fastener is in its disengaged position, it being understood that a wide variety of different arrangements may be provided to secure the front strap between the guitar and the front end of the slide tube.

Figure 4:
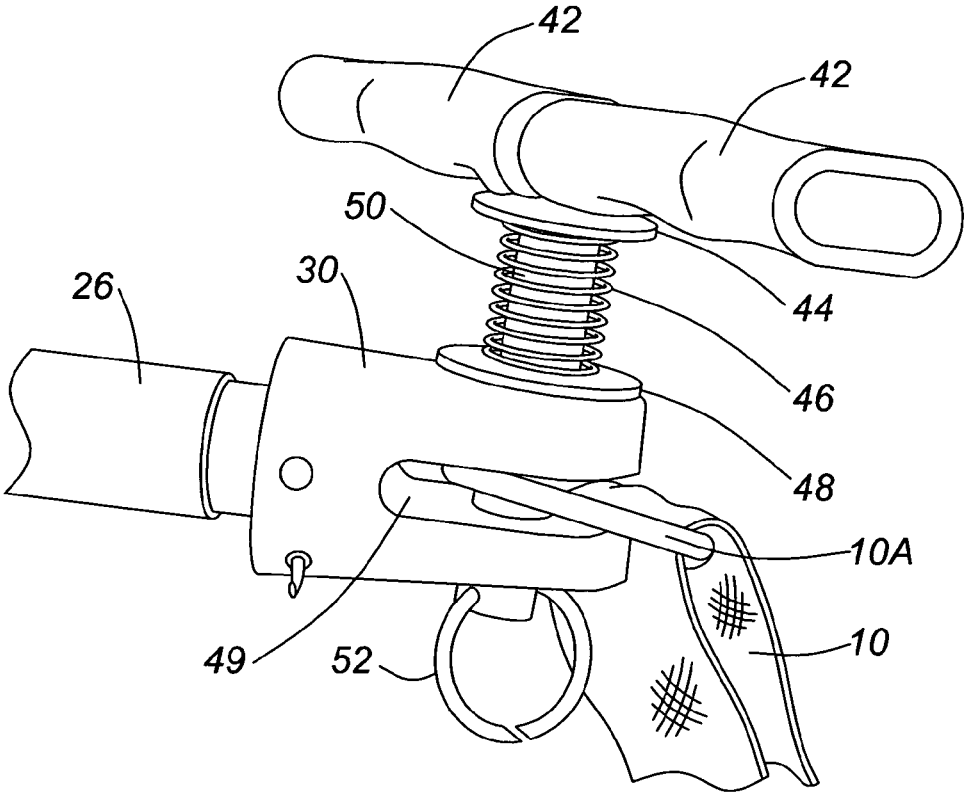
FIG. 4 is a perspective view of the rear seat and post positioned on the rear end of the slide tube.
Figure 5:
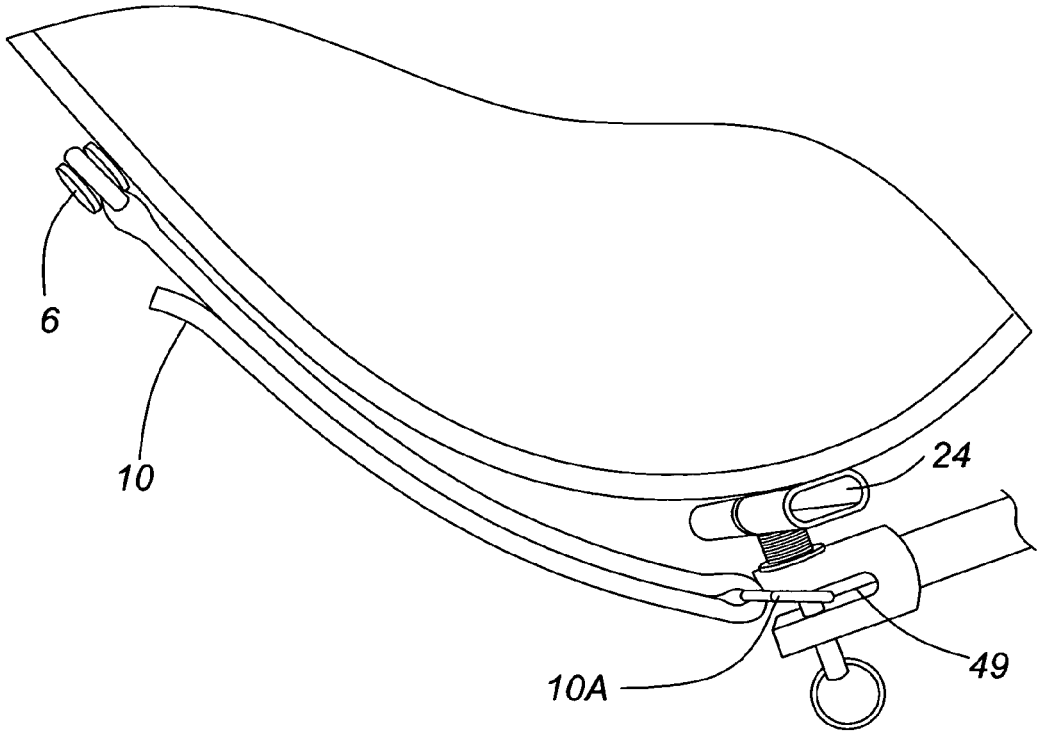
FIG. 5 is a perspective view of a portion of an acoustic guitar being supported by one embodiment of the present invention.
Figure 12:
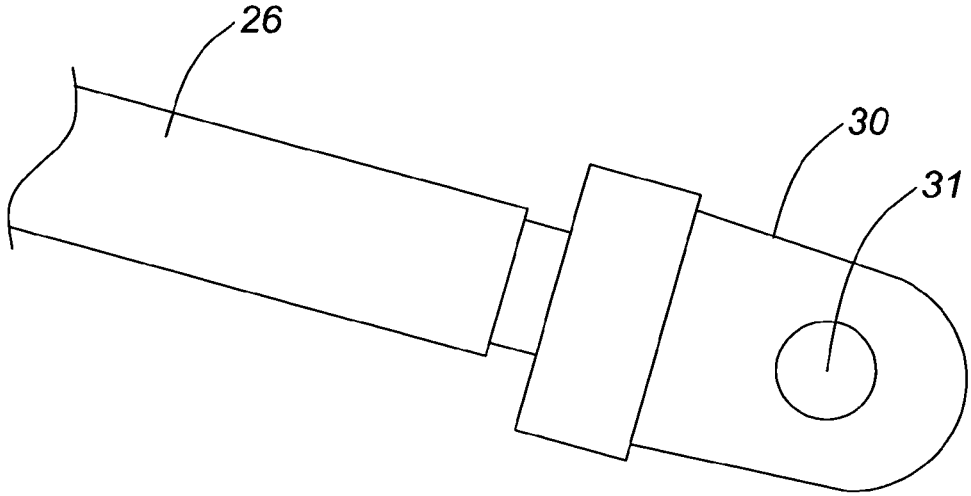
FIG. 12 is a perspective view of the rear end of the slide tube.

In the preferred embodiment, as illustrated in FIG. 3, the plastic covered foam 42 of the rear seat is supported by a support rod 36 in a manner similar to that of the front seat as previously described herein. The support rod 36 is welded or otherwise securely attached to the rear post 50, upon which is positioned an upper washer 44, spring 46, lower washer 48 and a cut end-ring 52 which may be inserted into a post hole 51 as illustrated in FIG. 3. To position and engage the rear post 50, one temporarily removes the cut end-ring 52 from the post 50 (by gently flexing or twisting the cut end-ring to allow the cut in the cut end-ring, (and thereafter the entire cut end-ring) to be rotated to a position outside of the hole in a manner known to a person skilled in the art), and thereafter inserts the rod 50 into the hole 31 in the rear end 30 of the slide tube (illustrated in FIG. 12), and as illustrated in FIG. 4, as the rod 50 is further inserted into the hole 31, the spring 46 is partially compressed between the upper washer 44 and lower washer 48, whereupon when the rod is inserted far enough that the post hole 51 extends beyond the hole in the rear end of the slide tube, the end-ring 52 is re-inserted into the post hole 51 in a manner known to a person skilled in the art, to secure the post 50 and rear seat to the rear end of the slide tube. It is understood that there are a wide variety of arrangements for attaching the rear seat and post to the rear end 30 of the sliding tube 26 as would be known to a person skilled in the art. When the rear seat is properly positioned, as illustrated in FIGS. 1 and 5, and the guitar has been positioned upon the rear seat, the spring 46 maintains a constant pressure on the upper washer 44 and thereby maintains a constant and gentle but firm pressure between the rubber cushions 44 and the guitar, the pressure being sufficient to take up any slack and help secure the installed guitar, but gentle enough to avoid damaging the installed guitar. In one embodiment of the present invention, adjustable support posts similar to the ones previously described in reference to the front seat, may also be positioned and attached in a similar manner to the rear seat (through, for example, appropriately positioned slots in the rear seat).

As illustrated in FIGS. 1, 4, 5, 7A, 8 and 9 in one embodiment of the present invention, a rear strap 10 is provided, preferably having on one end thereof a strap post fastener 6A securely attached thereto for attachment to a strap post 6 (as illustrated in FIG. 7A) which has been attached to the guitar in a conventional manner, and having attached on the other end thereof (as illustrated in FIG. 4), a rear strap ring 10A which may be engaged, for example, through a slot 49 in the rear end of the slide tube with the rear post 50. It is understood that a wide variety of arrangements may be provided for securely fastening the rear strap to the guitar, and to the rear end of the slide tube. In the preferred embodiment, the rear strap also uses a Velcro® hook and loop fastener system illustrated in FIG. 9 in the disengaged arrangement, the Velcro® hooks 10B being securely attached to one surface of the strap and loops 10C being securely attached to a corresponding opposite surface of the strap, it being understood that a wide variety of different arrangements may be provided to quickly and easily secure the strap between the strap post of the guitar and the rear end of the slide tube.

In the preferred embodiment of the present invention, as illustrated in FIGS. 13, 14A, 14B and 14D, a pivotable support is provided, having a hole 32B therethrough which is slightly larger than the diameter of the slide tube 26 so that the slide tube may slide easily through the hole 32B, allowing the slide tube 26 and supported guitar to slide along the length of the slide tube relative to the vertical post 99 and ground as shown by the arrow 27 in FIG. 1, and also permitting the slide tube (and supported guitar) to freely and readily rotate about the longitudinal axis of the hole 32B. In one embodiment of the present invention, rubber washers are provided at each end of the slide tube to prevent metal to metal contact between the pivotable support and either end of the slide tube). In one embodiment of the present invention, a bolt or threaded rod may be inserted into the threaded hole 32A and tightened against the slide tube positioned therein to fix or limit the movement of the slide tube relative to the hole 32B, to thereby temporarily secure the slide tube (and supported guitar) in that position and orientation. Alternatively, the slide tube 26 is provided with a machined out curved surface for interacting with a curved pressure plate when pressure is applied thereto using, for example, a threaded turn knob interacting with a threaded bore disposed in the pivotable support. In one embodiment of the present invention, as illustrated in FIGS. 15A, 15B and 15C, holes 200 are provided along the length of and around the circumference of the slide tube, and holes 202A and 202B are provided in the pivotable support (the holes 202A being positioned in one embodiment, on the top of the pivotable support as illustrated in FIG. 15A, and holes 202B being positioned on the bottom of the pivotable support and in alignment with the corresponding holes 202A), so that the musician may, by moving the slide tube to align the holes therein with the holes 202A and 202B in the pivotable support, and thereafter inserting a pin having two ends 204A and 204B through the aligned holes, temporarily lock out any movement of the slide tube in relation to the pivotable support. In another embodiment of the present invention, as illustrated in FIG. 15D, the musician may temporarily lock out all or substantially all of the nonrotational movement of the slide tube in relation to the pivotable support by inserting a first pin having two ends 206A and 206B through aligned holes in the slide tube which are substantially adjacent to one side of the pivotable support and a second pin having two ends 208A and 208B through aligned holes in the slide tube which are substantially adjacent to the other side of the pivotable support, the pins eliminating or substantially limiting the longitudinal movement of the slide tube relative to the pivotable support while permitting the rotational movement (as shown by the arrow 210) of the slide tube relative to the pivotable support, in a manner known to a person skilled in the art.

Figure 13:
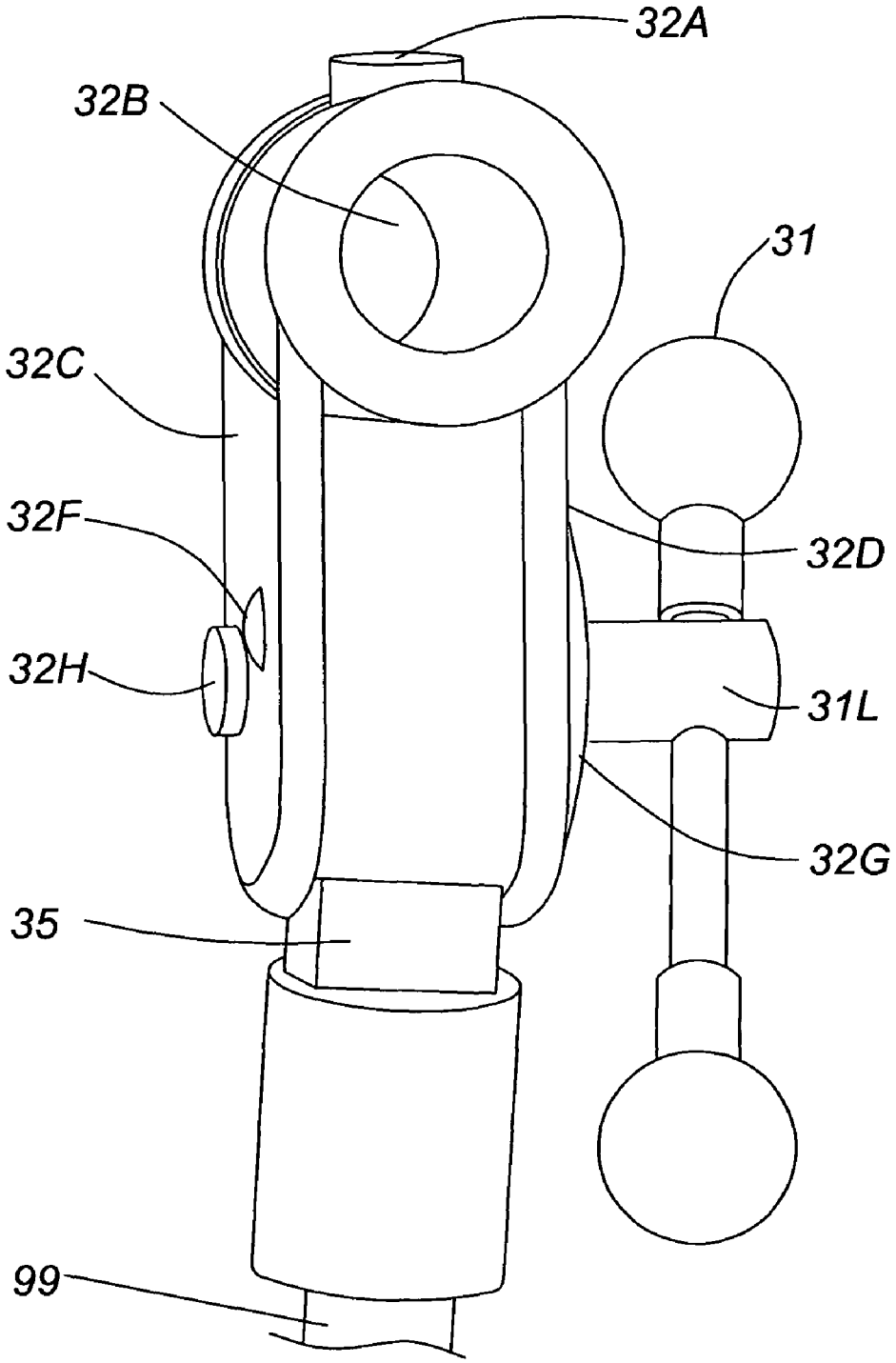
FIG. 13 is a perspective view of the pivotable support of one embodiment of the present invention.

The pivotable support of the preferred embodiment of the present invention, as illustrated in FIG. 13, has two substantially vertical opposing surfaces 32C and 32D extending therefrom and in spaced relationship to one another, having corresponding holes 32K (illustrated in FIG. 14D) therethrough through which a threaded bolt 32F may pass, the bolt 32F having positioned on the threaded end thereof, a nut 31L (illustrated in FIG. 13) or other threaded device, preferably having a handle 31 welded or otherwise securely fastened thereto, to allow the nut 31L or other threaded device to be readily tightened or loosened by the user as desired. Positioned between the two substantially vertical opposing surfaces 32C and 32D of the pivotable support, in the preferred embodiment of the present invention, a substantially vertical disc 35, as illustrated in FIGS. 13 and 14C is provided, the thickness of the disc 35 being such that the pivotable support can readily rotate, as more fully described herein, relative to the disk 35, when the nut or other threaded device is in an un-tightened position. A hole 35A is provided in the disk 35, to allow the bolt 32F to pass therethrough, the bolt 32F and hole 35A providing a point of rotation for the pivotable support, so that, when the user wishes to rotate the pivotable support, the nut 31L or other threaded device may be loosened by the user, and thereafter the pivotable support rotated about the bolt to the desired orientation, and thereafter the nut 31L or other threaded device may be tightened, to securely engage the inner surfaces of the two substantially vertical opposing surfaces 32C and 32D with the surfaces of the disc 35, thereby securely and temporarily fixing the pivotable support to the disk 35.

Figure 11:
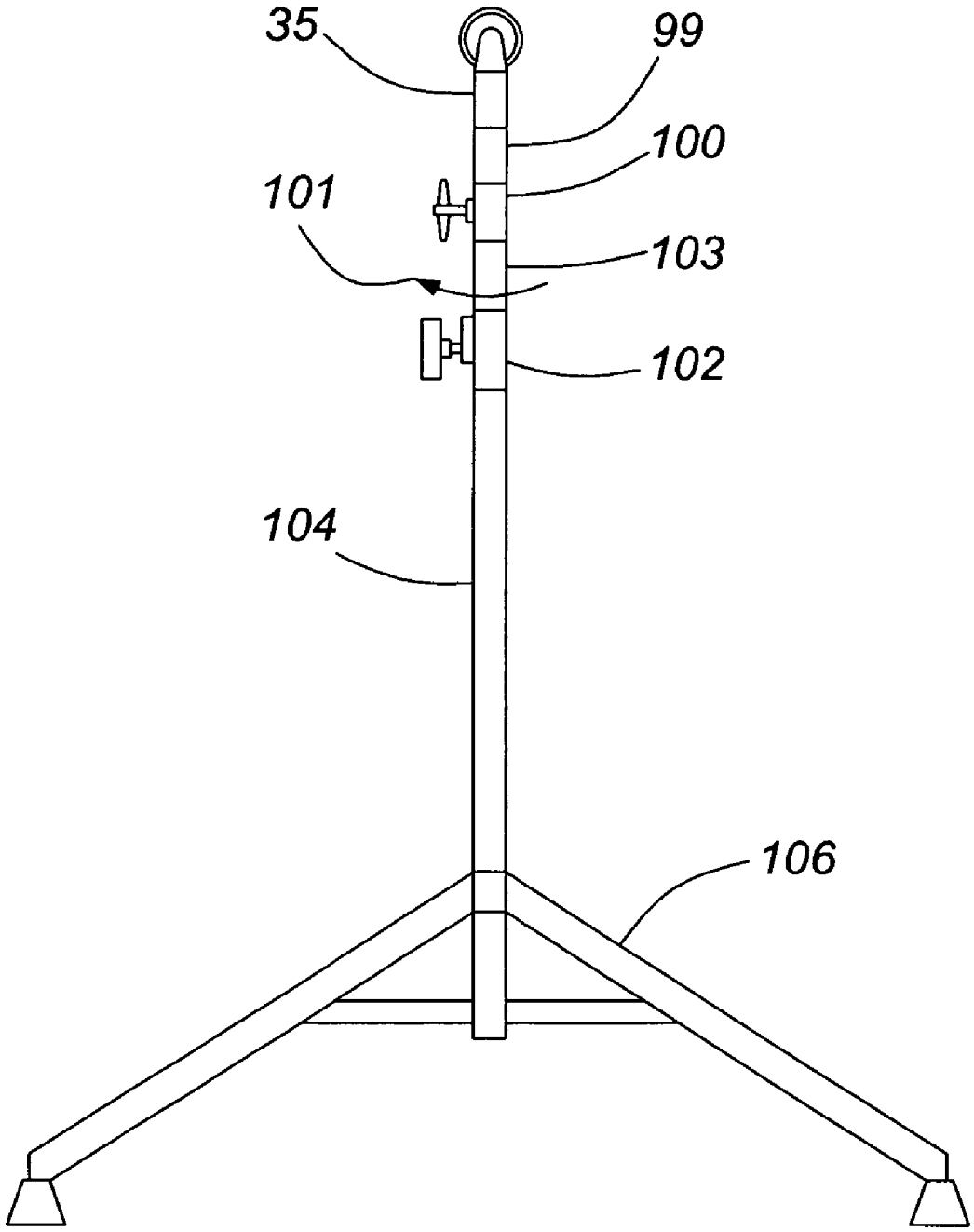
FIG. 11 is a perspective view of one embodiment of a support stand.

The disc 35 may be welded or otherwise securely attached to the support post 99, as illustrated in FIG. 11, by means of, for example, a threaded coupling, or by other means known to a person skilled in the art.

Figure 14A:
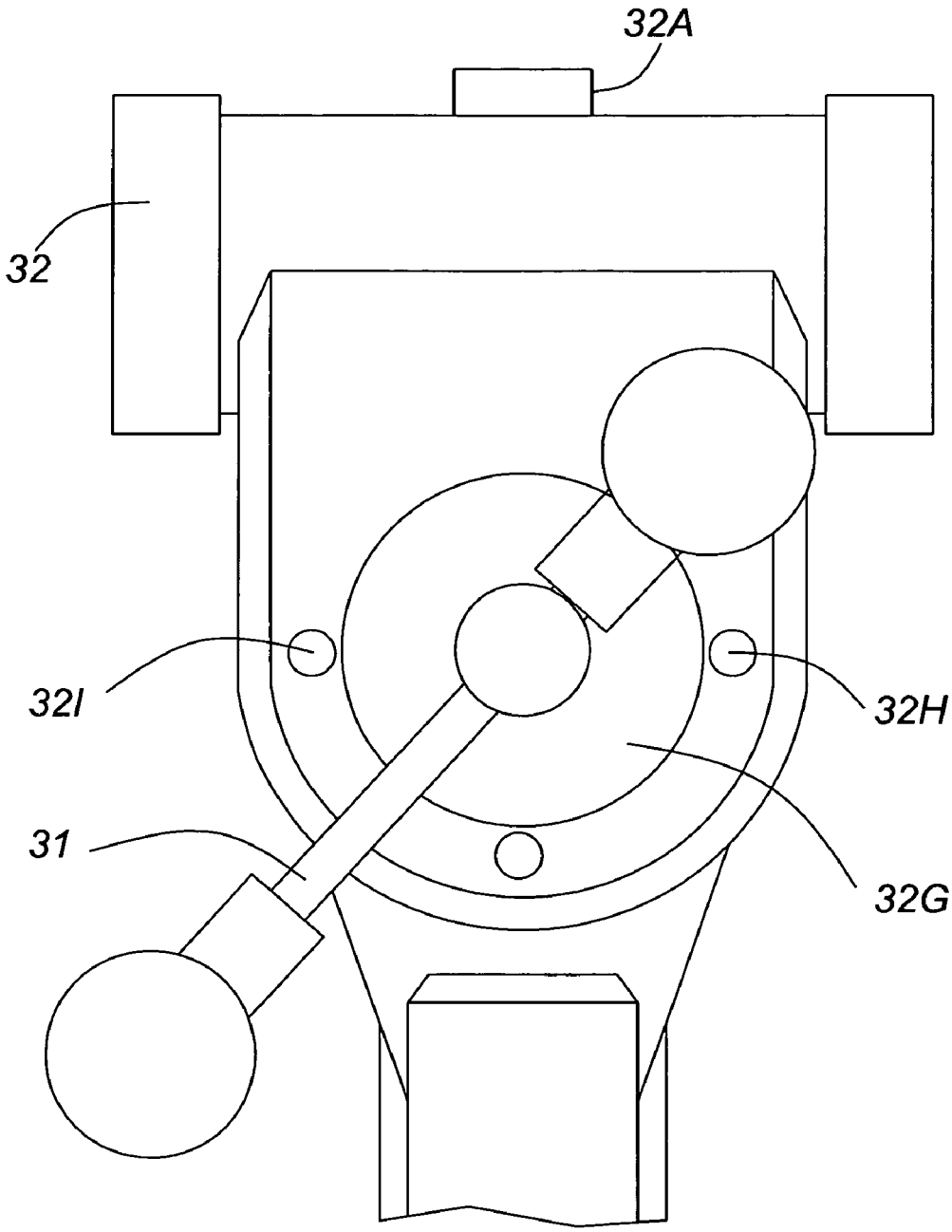
FIG. 14A is another perspective view of the pivotable support of one embodiment of the present invention.
Figure 14B:
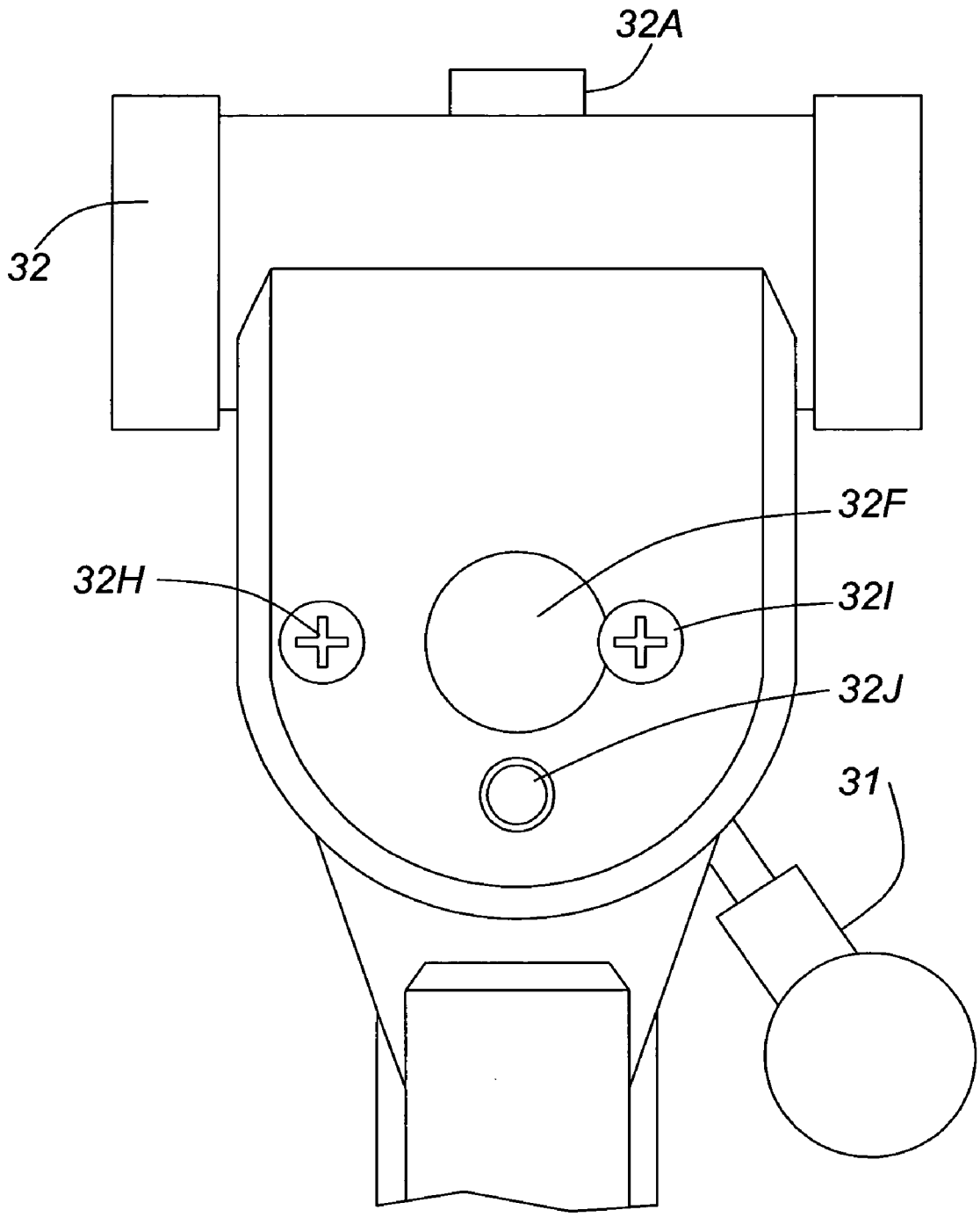
FIG. 14B is another perspective view of the pivotable support of one embodiment of the present invention.
Figure 14C:
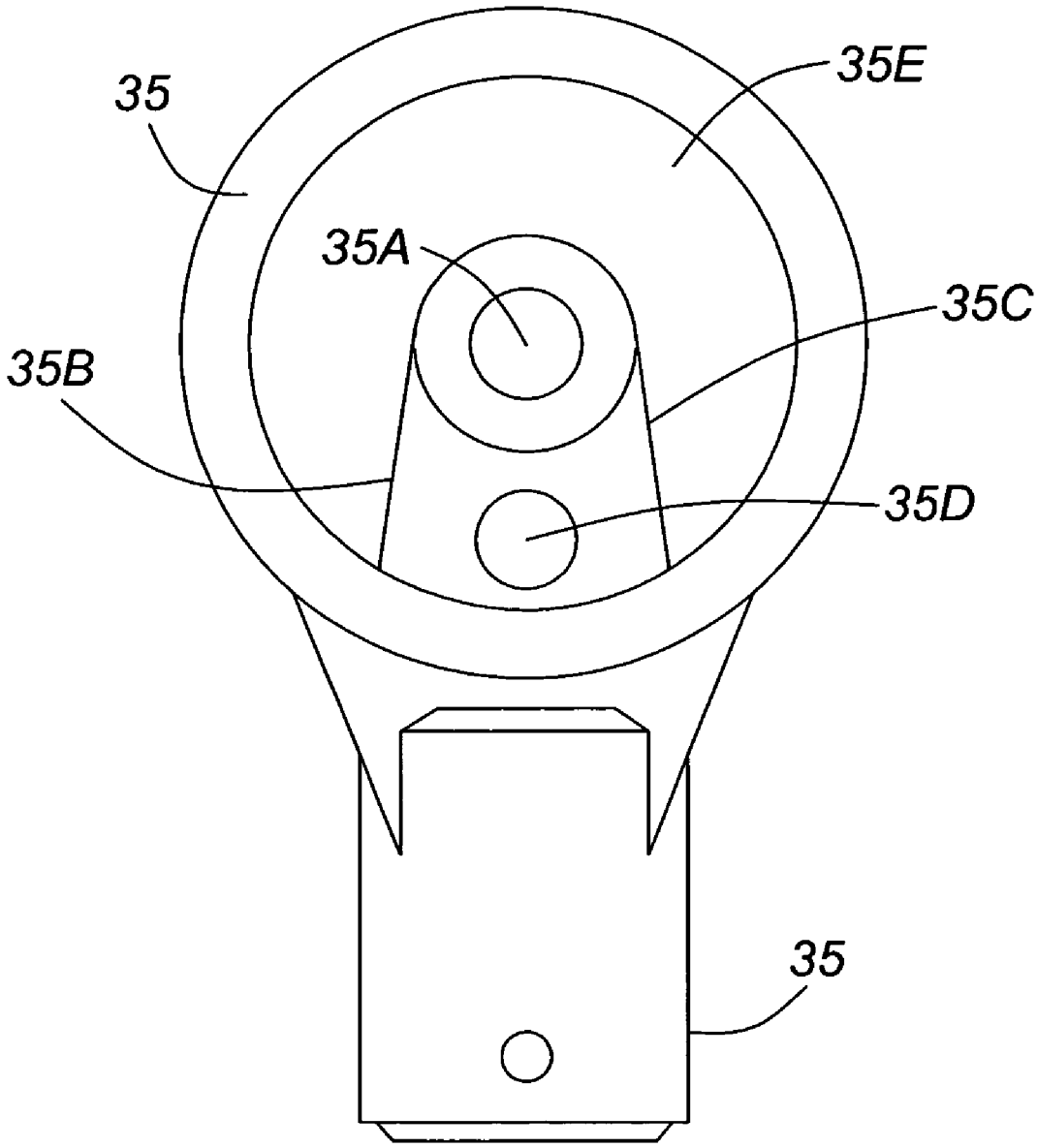
FIG. 14C is a perspective view of the support disk of one embodiment of the present invention.
Figure 14D:
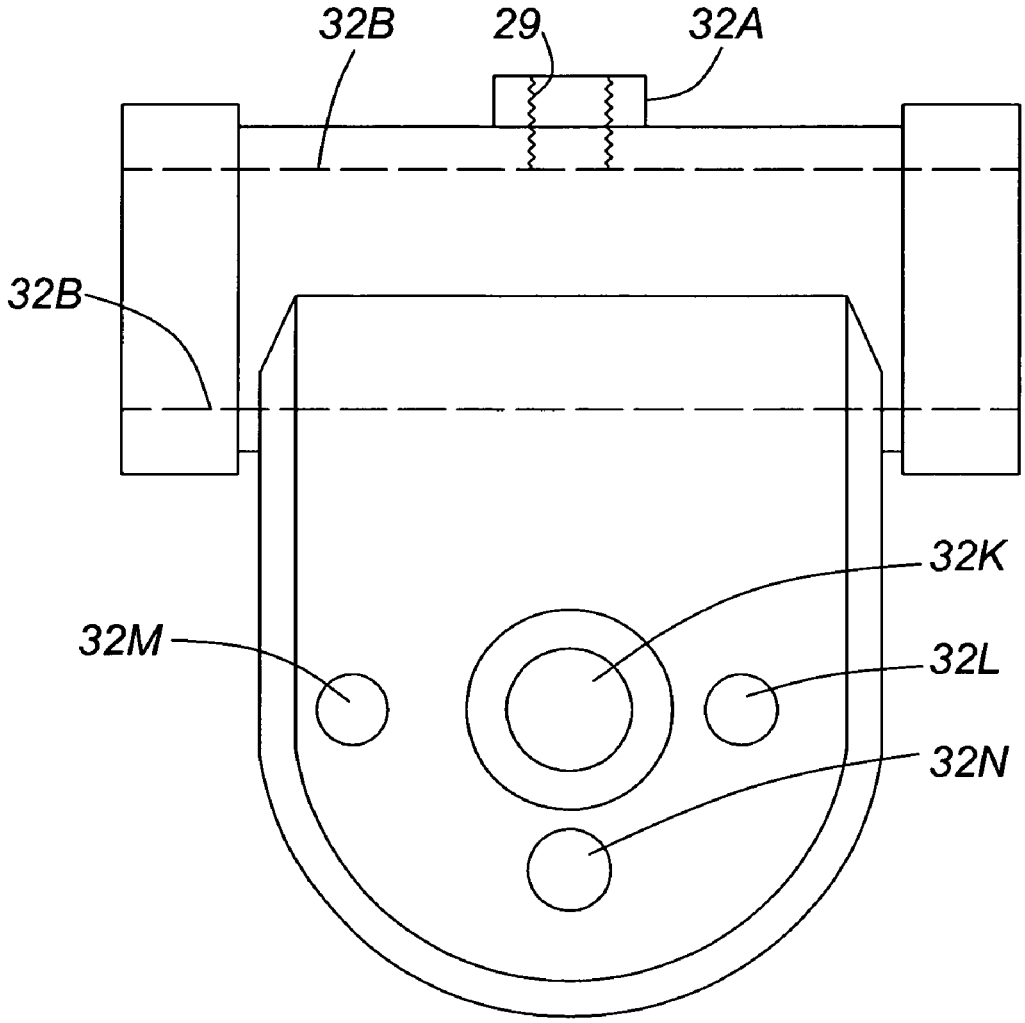
FIG. 14D is a perspective view, partly in ghost, of a portion of the pivotable support of one embodiment of the present invention.
Figure 15A:
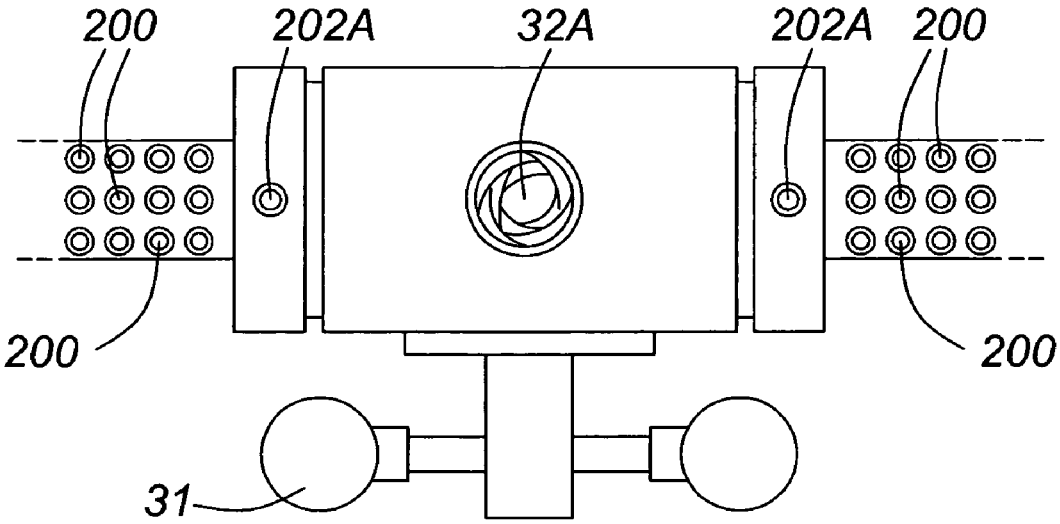
FIG. 15A is a top perspective view of the pivotable support and a portion of slide tube having holes therein in one embodiment of the present invention.
Figure 15B:
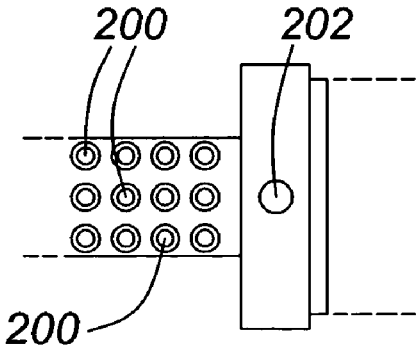
FIG. 15B is a top perspective view of a portion of the pivotable support and a portion of slide tube having holes therein with a positioning pin inserted through a hole in the pivotable support in one embodiment of the present invention.
Figure 15C:
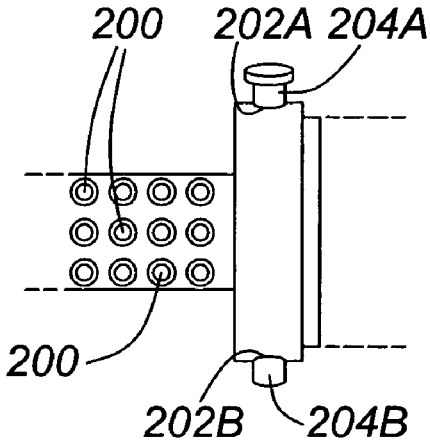
FIG. 15C is a side perspective view of a portion of the pivotable support and a portion of slide tube having holes therein with a positioning pin inserted through a hole in the pivotable support in one embodiment of the present invention.
Figure 15D:
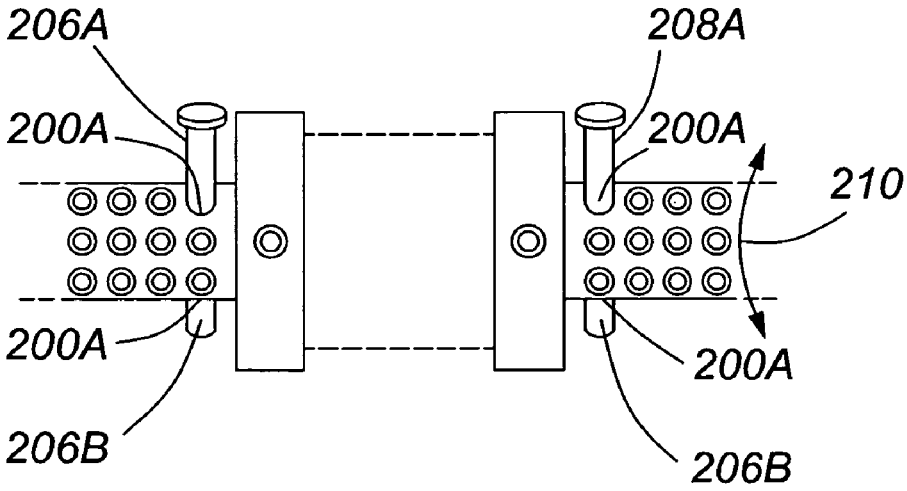
FIG. 15D is a side perspective view of a portion of the pivotable support and a portion of the slide tube having holes therein with positioning pins inserted through holes in the slide tube in one embodiment of the present invention.
Figure 16A:
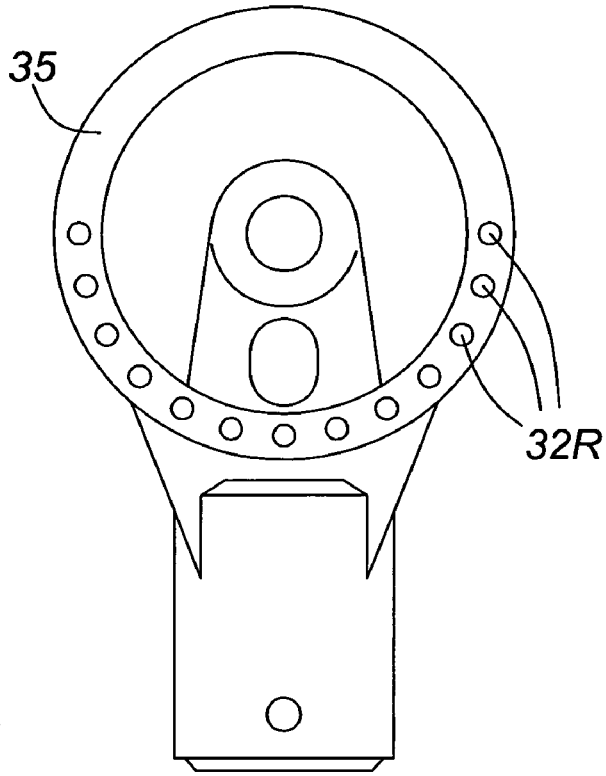
FIG. 16A is a perspective view of the support disk of an alternative embodiment of the present invention with positioning pinholes.
Figure 16B:
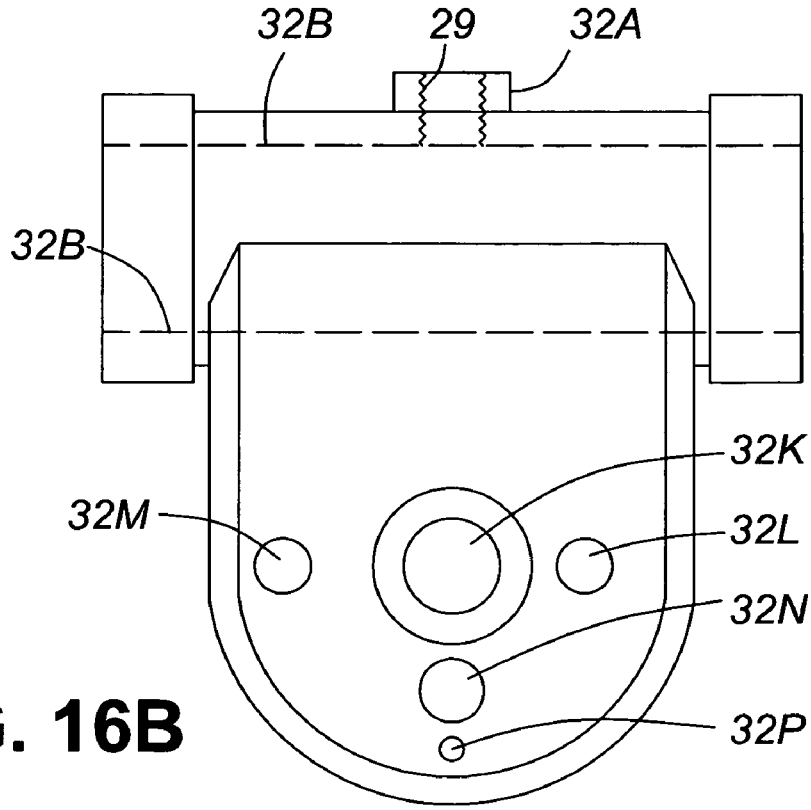
FIG. 16B is a perspective view, partly in ghost, of a portion of the pivotable support of one embodiment of the present invention.

In one embodiment of the present invention, two stop bolt holes 32L and 32M are provided in both of the two substantially vertical opposing surfaces 32C and 32D as illustrated in FIG. 14D, so that when it is desirous to limit the possible rotation of the pivotable support relative to the disk (and stand), one may insert stop bolts 32H and 321 through each of the corresponding holes in the two substantially vertical opposing surfaces 32C and 32D as illustrated in FIGS. 14A and 14B (both bolts passing through hole 35E in the disc), so that the rotation of the pivotable support is thereby limited (the stop bolts 32H and 32I rotate as the pivotable support rotates so that one of the stop bolts will come into contact with one of the stop surfaces 35B or 35C to thereby prevent any undesired over-rotation of the pivotable support). To lock out all rotation of the pivotable support one rotates the pivotable support to align the hole 32J with the hole 35D and thereafter insert an appropriately sized bolt (not shown) through the aligned holes 32J and 35D, to thereby temporarily and securely prevent rotation of the pivotable support. In one embodiment of the present invention, as illustrated in FIGS. 16A and 16B, a series of holes 32R are arranged on disk 35, and, to temporarily lock out movement of the pivotable support relative to the disk 35, the pivotable support may be rotated to the desired orientation and thereafter adjusted to align the hole 32P in the pivotable support with the nearest hole 32R in the disk 35, and thereafter a bolt or pin may be inserted into and through the hole 32P and the aligned nearest hole 32R to temporarily lock out movement of the pivotable support relative to the disk in a manner known to a person skilled in the art.

In one embodiment of the present invention, the support post 99 may be mounted on a stand such as the one illustrated in FIG. 11, by, for example, inserting the support post 99 into a hollow intermediate post 103, and thereafter temporarily securing it to the hollow intermediate post 103 in a conventional manner known to a person skilled in the art (it also being understood that prior to temporarily securing the support post 99 to the hollow intermediate post 103, the support post 99 can be moved up or down relative to the hollow intermediate post 99 to thereby adjust the height of the guitar or other instrument). In a preferred embodiment, the intermediate post 103 may be securely and rotatably attached to a main post 104 in a manner known to a person skilled in the art, to allow the intermediate post 103, support post and support device to freely rotate (as shown by arrow 101) about a substantially vertical axis when desired, in a manner known to a person skilled in the art. In one embodiment of the present invention, the main post may be supported by legs 106 in a conventional manner, or alternatively, alternative methods may be used to support the main post 104 in a substantially vertical or alternative orientation as desired.

In the event that the musician wishes to move around during the practice or performance, the musician is free to move the guitar, support device and stand as desired. Alternatively, a quick release may be provided, allowing the guitar to be quickly removed from the stand and played separately from the stand and subsequently quickly re-attached when desired.

It is understood that in the preferred embodiment of the present invention, a guitar, which is properly attached to the support device of the present invention will possess five degrees of freedom (i.e. five essential movements), namely, the guitar can be raised or lowered vertically, relative to the stand 106 or ground, tilted in a clockwise/counter clockwise direction (about the longitudinal axis of the threaded bolt 32F in the pivotal support 32, rolled back and forth (about the longitudinal axis of the slide tube 26, rotated (about the longitudinal axis of the support post 99, and can slide from side to side (parallel to the longitudinal axis of the slide tube 26). It is understood that all these movements can occur simultaneously, and in the event that the vertical raise or lower feature is locked the guitar player may move the guitar throughout a wide range of movements while not supporting any or a substantial portion of the guitar's weight. Furthermore, it is understood that any combination of features/movements of the support of the present invention can be temporarily locked out to permit the guitar player the desired level of flexibility and support.

While the present invention has been described with reference to manually operated controls, it is understood that in an alternative embodiment of the present invention, one or more automatic or remote activation controls may be utilized to engage or disengage these control functions.

The present invention has been described herein with regard to preferred embodiments. However, it will be obvious to persons skilled in the art that a number of variations and modifications can be made without departing from the scope of the invention as described herein.

What is claimed is:

1. A device for supporting a musical instrument on a stand while playing the instrument comprising:

a support structure for transmitting at least a substantial portion of a weight of the musical instrument to the stand while enabling relative movement between the musical instrument and the stand that permits the pivoting of the support structure relative to the stand while the instrument is being moved by a user during playing of the instrument and supports the instrument during the pivoting of the support structure at the height at which the instrument is currently held by said support structure or at another height to which the user moves the instrument, the support structure comprising an engaging structure for securely engaging with the stand;

a support seat mounted to the support structure for engaging with and supporting the musical instrument, wherein the support seat is provided to contact the musical instrument directly; and, a securing mechanism mounted to at least one of the support structure and the support seat for securing engagement of the musical instrument with the support seat during the relative movement;

wherein the support structure is configured for relative movement in regard to the support seat so that the support structure is movable by a user during the playing of the instrument;

wherein the support structure comprises a first mechanism for enabling rotational movement of the musical instrument about at least one of three axes, the three axes being oriented other than parallel to each other;

wherein the engaging structure comprises a support post, a longitudinal axis of the support post being oriented substantially vertical when engaged with the stand, the support post being engaged with the stand such that it is rotatable movable about the longitudinal axis of the support post; and, wherein the support structure comprises a pivotable support comprising a first portion mounted to the support post and a second portion pivotable movable mounted to the first portion, the second portion being rotatable movable about a pivot axis oriented substantially perpendicular to the longitudinal axis of the support post.

2. A device for supporting a musical instrument on a stand as defined in claim 1 wherein the support structure comprises a second mechanism for enabling longitudinal movement of the musical instrument along at least one of the three axes.

3. A device for supporting a musical instrument on a stand as defined in claim 1 wherein the support structure comprises an intermediate support structure having the support seat mounted thereto, the intermediate support structure being mounted to the pivotable support such that the intermediate support structure is at least one of rotatable movable about an intermediate support axis oriented substantially perpendicular to the pivot axis and longitudinal movable along the intermediate support axis.

4. A device for supporting a musical instrument on a stand as defined in claim 1 comprising at least a support post mounted to the support seat for limiting movement of the musical instrument with respect to the support seat.

5. A device for supporting a musical instrument on a stand as defined in claim 1 wherein the securing mechanism comprises a strap ring for engaging a strap.

6. A device for supporting a musical instrument on a stand as defined in claim 5 comprising a strap for being engaged with the musical instrument and the strap ring.

7. A device for supporting a musical instrument on a stand as defined in claim 1 wherein the support seat is mounted in a spring loaded fashion.

8. The device of claim 1, wherein said support seat is pivotal in a direction lateral to the stand.

9. The device of claim 1, wherein the securing mechanism includes at least one strap that is configured to connect to the instrument.

10. The device of claim 9, wherein the at least one strap is releasably engageable with the instrument.

11. The device of claim 9, wherein the straps are releasably engageable with the instrument.

12. The device of claim 1, wherein the securing mechanism includes straps that are configured to connect to the instrument.

13. The device of claim 1, wherein the support structure is movable relative to the stand and while engaging the instrument permits movement of the instrument relative to the stand, and wherein the relative movement includes lateral movement and rotational movement relative to the stand.

14. The device of claim 1, wherein said support structure is pivotally held on said stand and wherein the pivoting of the support structure is configured to pivot through an unlimited number of forward and reward pivotal rotations relative to the stand while the instrument is being supported by said device.

15. The device of claim 1, wherein said support structure enables relative movement between the musical instrument and the stand that permits the floating positioning and movement of the instrument held by said support structure relative to the stand while the instrument is being played.

16. A device for supporting a musical instrument on a stand comprising:

a support structure for transmitting at least a substantial portion of a weight of the musical instrument to the stand while enabling relative movement between the musical instrument and the stand, the support structure comprising an engaging structure for securely engaging with the stand;

a support seat mounted to the support structure for engaging with and supporting the musical instrument; and, a securing mechanism mounted to at least one of the support structure and the support seat for securing engagement of the musical instrument with the support seat during the relative movement;

wherein the support structure comprises a first mechanism for enabling rotational movement of the musical instrument about at least one of three axes, the three axes being oriented other than parallel to each other;

wherein the engaging structure comprises a support post, a longitudinal axis of the support post being oriented substantially vertical when engaged with the stand, the support post being engaged with the stand such that it is rotatable movable about the longitudinal axis of the support post;

wherein the support structure comprises a pivotable support comprising a first portion mounted to the support post and a second portion pivotable movable mounted to the first portion, the second portion being rotatable movable about a pivot axis oriented substantially perpendicular to the longitudinal axis of the support post;

wherein the support structure comprises an intermediate support structure having the support seat mounted thereto, the intermediate support structure being mounted to the pivotable support such that the intermediate support structure is at least one of rotatable movable about an intermediate support axis oriented substantially perpendicular to the pivot axis and longitudinal movable along the intermediate support axis;

wherein the intermediate support structure comprises a slide tube which is slidable and rotatable accommodated in a bore disposed in the second portion of the pivotable support.

17. A device for supporting a musical instrument on a stand as defined in claim 16 comprising a blocking device for providing one of blocking of the longitudinal movement of the intermediate support structure and enabling limited longitudinal movement of the intermediate support structure.

* * * * *